US007029072B1

(12) United States Patent
Murray et al.

(10) Patent No.: US 7,029,072 B1
(45) Date of Patent: Apr. 18, 2006

(54) MODIFIED RUMBLE STRIP CUTTER

(75) Inventors: Stuart W. Murray, Brentwood, TN (US); Scott Lyons, Nashville, TN (US)

(73) Assignee: Wirtgen America, Inc., Nashville, TN (US)

( * ) Notice: Subject to any disclaimer, the term of this patent is extended or adjusted under 35 U.S.C. 154(b) by 95 days.

(21) Appl. No.: 10/321,776

(22) Filed: Dec. 17, 2002

Related U.S. Application Data

(60) Provisional application No. 60/363,137, filed on Mar. 11, 2002.

(51) Int. Cl.
*E01C 23/09* (2006.01)

(52) U.S. Cl. ..... 299/39.5; 299/39.4; 404/94

(58) Field of Classification Search ..... 404/93, 404/94, 90; 299/39.1, 39.3–39.6, 73, 75
See application file for complete search history.

(56) References Cited

U.S. PATENT DOCUMENTS

| | | | | | |
|---|---|---|---|---|---|
| 2,997,798 | A | | 8/1961 | Ruth | 37/124 |
| 3,094,047 | A | | 6/1963 | Patton | 94/45 |
| 3,483,806 | A | | 12/1969 | Williamson et al. | 94/50 |
| 3,590,701 | A | | 7/1971 | Broeck | 94/39 |
| 3,633,973 | A | | 1/1972 | Chesterman | 299/37 |
| 3,678,817 | A | | 7/1972 | Martenson et al. | 94/46 |
| 3,730,593 | A | | 5/1973 | Karlovsky, Jr. | 299/76 |
| 3,745,725 | A | | 7/1973 | Boucaud | 52/67 |
| 3,767,262 | A | * | 10/1973 | Pentith | 299/10 |
| 3,774,401 | A | | 11/1973 | Allen | 60/420 |
| 3,779,662 | A | | 12/1973 | Smith | 404/98 |
| 3,807,634 | A | | 4/1974 | Vogt | 239/150 |
| 3,933,218 | A | | 1/1976 | Oler et al. | 180/79.1 |
| 3,964,565 | A | | 6/1976 | Cagle et al. | 180/70 R |
| 3,964,835 | A | | 6/1976 | Eigenmann | 404/94 |
| 3,970,405 | A | | 7/1976 | Swisher, Jr. et al. | 404/105 |
| 3,976,146 | A | | 8/1976 | Desourdy | 172/788 |
| 3,980,342 | A | | 9/1976 | Dunham | 299/56 |
| 3,994,083 | A | | 11/1976 | Cunningham | 37/80 R |
| 3,997,277 | A | | 12/1976 | Swisher, Jr. et al. | 404/84 |
| 4,002,206 | A | | 1/1977 | Eisenhardt | 172/90 |
| 4,014,070 | A | | 3/1977 | Rifkin | 16/90 |
| 4,036,372 | A | | 7/1977 | Rao et al. | 212/144 |
| 4,089,730 | A | | 5/1978 | Mahn | 156/541 |
| 4,091,936 | A | | 5/1978 | Wuerflein et al. | 212/144 |
| 4,139,324 | A | | 2/1979 | Krings | 405/282 |
| 4,168,135 | A | | 9/1979 | Johansson et al. | 425/64 |
| 4,217,065 | A | | 8/1980 | Stilwell | 404/98 |
| 4,273,499 | A | | 6/1981 | Berko | 414/626 |

(Continued)

*Primary Examiner*—Sunil Singh
(74) *Attorney, Agent, or Firm*—Waddey & Patterson, P.C.; I. C. Waddey, Jr.; Phillip E. Walker

(57) ABSTRACT

A rumble strip cutting machine having a drum that can be shifted from one side of the machine to the other. The machine includes a piston wheel that imparts an up and down motion to the frame so that rumble strips can be cut at desired intervals as the machine is driven along the road shoulder. The piston wheel includes a wheel mounting assembly on each side of the machine so that the wheel can be conveniently shifted from one side of the machine to the other. Additional structures allow for the flexing of the machine frame, applying pressure to the cutting drum, adjusting the depth of cut, tightening the belt used to drive the drum, and lifting the machine for job site transportation. The machine enables a method of cutting rumble strips close to obstructions on narrow shoulders while driving the machine in the direction of moving traffic.

7 Claims, 15 Drawing Sheets

U.S. PATENT DOCUMENTS

| | | | | |
|---|---|---|---|---|
| 4,278,387 | A | 7/1981 | Seguela et al. | 414/462 |
| 4,290,820 | A | 9/1981 | Swisher, Jr. et al. | 134/6 |
| 4,350,222 | A | 9/1982 | Lutteke et al. | 180/209 |
| 4,380,842 | A | 4/1983 | Thomas | 15/304 |
| 4,421,365 | A | 12/1983 | Taniwaki | 312/198 |
| 4,433,936 | A | 2/1984 | Moser | 404/88 |
| 4,449,600 | A | 5/1984 | Telfer | 180/132 |
| 4,460,064 | A | 7/1984 | Lutz et al. | 187/9 R |
| 4,466,757 | A | 8/1984 | Allen | 404/114 |
| 4,467,225 | A | 8/1984 | Tanaka | 384/19 |
| 4,493,584 | A | 1/1985 | Guntert | 404/74 |
| 4,565,467 | A | 1/1986 | Eigenmann | 404/72 |
| 4,590,986 | A | 5/1986 | Scholz et al. | 164/448 |
| 4,639,970 | A | 2/1987 | Adams | 16/90 |
| 4,647,014 | A | 3/1987 | Ekman | 254/221 |
| 4,689,903 | A | 9/1987 | Gilbert | 37/103 |
| 4,701,069 | A | 10/1987 | Whitney | 404/75 |
| 4,705,491 | A | 11/1987 | Andersson | 464/167 |
| 4,710,054 | A | 12/1987 | Allen | 404/110 |
| 4,720,207 | A | 1/1988 | Salani | 404/90 |
| 4,744,604 | A | 5/1988 | Lewis et al. | 299/10 |
| 4,744,855 | A | 5/1988 | Ellenberger et al. | 156/499 |
| 4,749,304 | A | 6/1988 | Craig | 404/101 |
| 4,789,266 | A | 12/1988 | Clarke, Jr. et al. | 404/96 |
| 4,793,732 | A | 12/1988 | Jordon | 404/90 |
| 4,797,025 | A | 1/1989 | Kennedy | 404/90 |
| 4,798,495 | A | 1/1989 | Laeuppi | 404/100 |
| 4,799,820 | A | 1/1989 | Laeuppi et al. | 404/100 |
| 4,824,516 | A | 4/1989 | Ishihara et al. | 156/523 |
| 4,837,891 | A | 6/1989 | Toma et al. | 16/87.4 R |
| 4,869,995 | A | 9/1989 | Shirai et al. | 430/270 |
| 4,896,995 | A | 1/1990 | Simmons | 404/90 |
| 4,900,094 | A | 2/1990 | Sergeant | 299/39 |
| 4,900,186 | A | 2/1990 | Swisher, Jr. et al. | 404/105 |
| 4,901,421 | A | 2/1990 | Takarabe et al. | 29/437 |
| 4,909,575 | A * | 3/1990 | Lupton | 299/39.5 |
| 4,938,537 | A | 7/1990 | Rife, Jr. et al. | 299/39 |
| 4,943,119 | A | 7/1990 | Zarniko et al. | 299/1 |
| 4,950,088 | A | 8/1990 | Pipon et al. | 384/47 |
| 4,954,042 | A | 9/1990 | Becicka et al. | 414/718 |
| 4,986,604 | A | 1/1991 | Meister | 299/39 |
| 4,988,233 | A | 1/1991 | Kasler et al. | 404/108 |
| 4,995,758 | A | 2/1991 | Smith | 404/88 |
| 5,015,120 | A | 5/1991 | Brock et al. | 404/108 |
| 5,020,323 | A | 6/1991 | Hurlimann | 60/413 |
| 5,040,266 | A | 8/1991 | Hochen | 16/87.2 |
| 5,046,890 | A | 9/1991 | Dickson | 404/90 |
| 5,051,000 | A | 9/1991 | Cadwallader et al. | 384/7 |
| 5,059,061 | A | 10/1991 | Stenemann et al. | 404/72 |
| 5,061,115 | A | 10/1991 | Godbersen et al. | 404/102 |
| 5,073,063 | A | 12/1991 | Brown | 404/101 |
| 5,083,630 | A | 1/1992 | Zaun | 180/209 |
| 5,085,537 | A | 2/1992 | Laditka | 404/75 |
| 5,092,623 | A | 3/1992 | Swanner | 280/638 |
| 5,094,565 | A | 3/1992 | Johnson | 404/75 |
| 5,103,686 | A | 4/1992 | Rosenquist | 74/89.2 |
| 5,121,808 | A | 6/1992 | Visentini et al. | 180/155 |
| 5,123,665 | A | 6/1992 | Levy | 280/35 |
| 5,125,460 | A | 6/1992 | Behrens | 173/184 |
| 5,129,755 | A | 7/1992 | Dickson | 404/90 |
| 5,135,287 | A | 8/1992 | Karnes | 299/39 |
| 5,154,490 | A | 10/1992 | Burns | 301/44 B |
| 5,161,910 | A | 11/1992 | O'Konek | 404/90 |
| 5,169,262 | A | 12/1992 | Wilson et al. | 404/84 |
| 5,190,397 | A | 3/1993 | Bengford et al. | 404/88 |
| 5,195,746 | A | 3/1993 | Boyd et al. | 273/148 |
| 5,209,602 | A | 5/1993 | Godbersen | 404/88 |
| 5,230,600 | A | 7/1993 | Marino | 414/607 |
| 5,232,305 | A | 8/1993 | Bassett et al. | 404/101 |
| 5,236,278 | A | 8/1993 | Dickson | 404/90 |
| 5,259,692 | A | 11/1993 | Beller et al. | 404/90 |
| 5,282,644 | A | 2/1994 | Larson | 280/638 |
| 5,297,894 | A | 3/1994 | Yenick | 404/90 |
| 5,304,013 | A * | 4/1994 | Parsons | 404/127 |
| 5,318,377 | A | 6/1994 | Swisher, Jr. et al. | 404/74 |
| 5,349,783 | A | 9/1994 | Jasperson et al. | 49/425 |
| 5,360,272 | A | 11/1994 | Schmale et al. | 384/48 |
| 5,362,177 | A | 11/1994 | Bowhall et al. | 404/84.1 |
| 5,368,121 | A | 11/1994 | Priefert | 180/209 |
| 5,391,017 | A | 2/1995 | Thomas et al. | 404/90 |
| 5,405,212 | A | 4/1995 | Swisher, Jr. et al. | 404/74 |
| 5,415,495 | A | 5/1995 | Johnson | 404/84.05 |
| 5,454,583 | A | 10/1995 | Torborg | 280/638 |
| 5,456,547 | A | 10/1995 | Thomas et al. | 404/72 |
| 5,464,243 | A | 11/1995 | Maiwald et al. | 280/638 |
| 5,484,228 | A | 1/1996 | Thomas et al. | 404/90 |
| 5,489,113 | A | 2/1996 | Torborg | 280/638 |
| 5,489,114 | A | 2/1996 | Ward et al. | 280/638 |
| 5,503,499 | A | 4/1996 | Thomas et al. | 404/72 |
| 5,522,670 | A | 6/1996 | Gilmore et al. | 404/83 |
| 5,540,292 | A | 7/1996 | Behrens | 173/184 |
| 5,582,490 | A | 12/1996 | Murray | 404/90 |
| 5,590,977 | A | 1/1997 | Guntert et al. | 404/101 |
| 5,607,255 | A | 3/1997 | Thomas et al. | 404/90 |
| 5,615,972 | A | 4/1997 | Guntert et al. | 404/72 |
| 5,638,908 | A | 6/1997 | Masumoto et al. | 172/815 |
| 5,647,688 | A | 7/1997 | Guntert et al. | 404/101 |
| 5,676,490 | A * | 10/1997 | Nelson | 404/94 |
| 5,695,256 | A | 12/1997 | Kishimoto | 299/39.2 |
| 5,695,299 | A | 12/1997 | Thomas et al. | 404/94 |
| 5,772,233 | A | 6/1998 | Papendick | 280/638 |
| 5,779,390 | A | 7/1998 | Tuusinen | 404/101 |
| 5,860,764 | A * | 1/1999 | Roberts | 404/93 |
| 6,402,252 | B1 * | 6/2002 | Dickson | 299/39.6 |
| 6,454,490 | B1 * | 9/2002 | Murphy | 404/94 |

* cited by examiner

MODIFIED RUMBLE STRIP CUTTER

This application is a Non-Provisional application, which claims benefit of co-pending U.S. Provisional Patent Application Ser. No. 60/363,137 filed Mar. 11, 2002, entitled "Modified Rumble Strip Cutter" which is hereby incorporated by reference.

A portion of the disclosure of this patent document contains material that is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

Be it known that we, Stuart W. Murray, a citizen of the United States, residing at 9412 Ashford Place, Brentwood, Tenn. 37027; Scott F. Lyons, a citizen of the United States, residing at 5717 Cedar Ash Crossing, Nashville, Tenn. 37013; have invented a new and useful "Modified Rumble Strip Cutter."

BACKGROUND OF THE INVENTION

The present invention relates generally to the art of cutting rumble strips along the shoulder of a highway. Rumble strips, sometimes referred to as "SNAPs" (sonic noise alert patterns) are a series of grooves or depressions formed or cut into the surface of the shoulder of highways, roads, interstates, etc. The grooves provide vibration and therefore noise, when the tires of a vehicle traverse them longitudinally. Road departments use these rumble strips as a safety device longitudinally adjacent the edge of a highway, or along the center line which divides opposing directional traffic flows, are the customarily locations of placement of these rumble strips. They act to alert a driver that his or her vehicle has extended beyond the normal driving surface. Obviously, beyond this normal driving surface many dangerous conditions exist for a vehicle traveling at or near the posted speed limit. These dangers include dirt or gravel shoulders, guardrail barriers, signs, mailboxes, intersecting roadways or driveways, disabled vehicles and oncoming traffic.

Various specifications for the placement and physical dimensions of the individual rumble strips can vary from State to State and even within a particular State. A common size and placement, used for illustration and not limitation, places the individual rumble strips 12 inches apart from the center of one depression to the center of the adjacent depression. The measurements of the individual depressions are generally 7 inches from leading edge to back trailing edge with a depth at the deepest point, of one half inch, and at lateral length across a depression of 16 inches.

It is a difficult, if not impossible, task to form the rumble strips or depressions in the highway surfaces when the surfaces are being created. Moreover, the rumble strips are generally formed in the shoulders of the highways, which are not of the same density and load bearing capacity as the normal highway surface. Forming the depressions in the shoulders would be even more difficult because of the decreased density of the shoulder material and the difficulty in forming depression to cure in the desired shape would be very difficult. For that reason, it is the common practice to pour the shoulder of the highway in the traditional fashion and then follow along afterwards and cut the rumble strips into the shoulder.

Experience with use of rumble strips along the shoulders of highways has demonstrated their tremendous value as a lifesaving tool. If a driver has been driving for a long period of time and is getting fatigued, there is a tendency to nod off or fall asleep and allow the vehicle to drift off of the highway. If the vehicle drifts off to the right, it could go over an embankment and kill or cause sever bodily injury to the driver. With the rumble strips cut into the shoulder, once the vehicle veers off onto the shoulder, the noise created by the tires passing over the rumble strips will immediately awaken the drive and cause him/her to regain control of the vehicle and pull back onto the highway. Likewise, if the driver veers off to the left of the highway, particularly on interstate type highways that are at least two lanes running in each direction with a median in between, the driver could veer into on coming traffic with the potential of resulting head-on collisions that could produce tragic results for many people. Again, the provision of rumble strips on the left hand side of the two lane highway will awaken the driven and cause him to pull back onto the paved highway and avoid these head-on collisions. The value of these rumble strips in terms of their lifesaving effect is no longer open for debate. For that reason, the highway departments of most States are moving rapidly to have all major thoroughfares retrofitted to incorporate rumble strips in the shoulders of those highways.

As would be obvious, there are tens of thousands of miles of highways that need rumble strips cut in their shoulders. The efficiency in cutting the rumble strips is therefore very important. It is also very important to consider the comfort of the person operating the machine to cut the rumble strips and there are potential problems associated with the comfort of the operator in current methods and machinery to carry out those methods under current practices.

More specifically, rumble strip cutters available on the market today generally have a fixed cutting drum. As mentioned above, the cutting drum is usually approximately 16 inches in length and most machines used to drive the rumble strip cutters are at least 4 feet wide. Often, the cutting drum is mounted in the middle of the machine, leaving the drum at least 16 inches from the outside edge of both sides of the machine. These physical arrangements of the cutting drum within the machine make it very difficult to cut rumble strips at places on the road where the shoulder is very narrow, either because there is a drop off of the topography, or other obstacles such as bridge abutments, pylons, guardrails and the like. Other machines are configured so that the rumble strip cutting drum is adjacent one side of the machine so as to enable the machine to make close cuts in situations where the shoulder of the road is very narrow for any of the reasons as indicated above. However, historically, the cutting drums of these machines are always fixed in place or, at a minimum, cannot be conveniently moved from one side of the machine to the other. Thus, on an interstate type highway where there are four lanes of traffic, two in each direction, if the drum is mounted to the right side of the machine, when cutting the rumble strips in the right shoulder, the machine can move in the direction of flow of the traffic and cut rumble strips on narrow shoulders. However, when cutting rumbles in the left shoulder, the machine must either be driven into the direction of traffic, creating major safety hazards for the operator, or the machine can function properly only in areas that have very wide shoulders. Even if the machine could be operated moving against the direction, traffic control becomes a major problem.

What is needed then is a rumble strip cutting machine that has a drum that can be conveniently shifted from one side of the machine to the other and a machine that will enable a method of cutting rumble strips close to obstructions on narrow shoulders while always driving the machine in the direction of moving traffic on the highway. Such a machine and method is not currently available in the prior art.

SUMMARY OF THE INVENTION

The present invention is directed to a machine and method of cutting rumble strips in the shoulders of highways.

More specifically, the rumble strip cutter of the present invention is generally mounted on a self-propelled vehicle so that the rumble strip cutter can be pulled or pushed along the shoulder of a highway and cut rumble strips in that shoulder as the machine progresses. Considering the size specified for rumble strips, with rumble strips normally being in the range of approximately 7 inches in width and cut on 12 inch centers, the cutting of 5,280 rumble strips per mile of road shoulder would be required. A project of this nature can be very expensive and it is therefore highly desirable to be able to cut the rumble strips at a very fast pace in order to control costs.

Further, the speed at which rumble strips can be cut is limited because of the vibrations transferred from the cutting machine to the operator of the machine. A machine that moves up and down to cut the rumble strips has to be driven relatively slowly by the operator because if driven at a high rate of speed, the machine will vibrate the operator to a point where he can only work for brief periods of time. One example of a rumble strip cutter in which the machine moves up and down is illustrated in the patent granted to one of the co inventors of this invention, namely U.S. Pat. No. 5,582,490.

Thus, it is a highly desirable objective to isolate the oscillatory movement employed to cut the rumble strips from the machine that is being used to pull or push the rumble strip cutter along the shoulder of the highway.

It is further a desirable objective for an efficient rumble strip cutter to be able to lift the cutter out of engagement with the road so that the machine can be driven at a relatively rapid rate of speed from one job site to another.

It is yet another desirable objective for a rumble strip cutter to have a machine in which the rumble strip cutting drum can be easily moved from one side of the machine to the other so that the rumble strip cutter can be driven in the direction of moving traffic on an interstate type highway regardless of which shoulder of the highway is being cut, while being able to cut close to obstructions and on narrow shoulders.

It would also be desirable to have a rumble strip cutter with a housing that can accommodate various cutter drum widths.

Another desirable feature for a rumble strip cutter is to have a device that will provide additional pressure to hold the rumble strip cutting drum in cutting engagement with the road surface as the machine is operated.

Another desirable objective for a rumble strip cutter is to have a machine on which the power supply belt can be adjusted to increase or decease the tension on the belt so as to maximize the efficiency of the drive train power system.

These and other desirable objectives for an efficient rumble strip cutter and method for cutting rumble strips are achieved by the present invention.

In summary, the present invention includes:

A method of cutting rumble strips in a highway shoulder, including positioning a piston wheel and rumble strip cutting drum on the left side of a power driven machine for cutting rumble strips on the left shoulder of a highway, and moving said piston wheel and rumble strip cutting drum to the right side of said power driven machine for cutting rumble strips on the right shoulder of a highway.

A method of cutting rumble strips in a highway shoulder, including providing a rumble strip cutter frame having a left side and a right side; providing a mechanism for attaching said frame to a self propelled machine; attaching a piston wheel and cutter drum to the right side of said frame for cutting rumble strips in the right shoulder of a highway, and repositioning said piston wheel and cutting drum to the left side of said frame for cutting rumble strips in the left shoulder of a highway.

An improved rumble strip cutting machine including a pair of spaced apart, generally parallel rails having opposing ends with one end of said rails having connectors for connection of said improved rumble strip cutting machine to a tractor and the opposite ends of said rails being connected by a cutting drum housing; an axle extending through said housing a power input source connected to said axle to rotatably drive said axle; a rumble strip cutting drum removable mounted to said axle adjacent one of said rails; and said axle including mounting structure adjacent the other of said rails whereby said rumble strip cutting drum can be removed from the position adjacent said one of said rails and attached to said mounting structure adjacent said other of said rails.

An improved rumble strip cutter for cutting rumble strips in a road surface including: a rumble strip cutter frame having opposing sides; a piston wheel for imparting up and down motion to a portion of said frame; a connector for connecting a portion of said frame to a tractor so that a portion of said frame can pivot in an up and down motion; a rumble strip cutting drum removably mounted on one side of said frame; lifting structure positioned between said connector and said drum for connection of said frame to a tractor enabling said rumble strip cutting frame to be lifted so that the cutting drum can be spaced from the road surface when the rumble strip cutter is being moved from one job site to another.

A rumble strip cutting machine including a frame having opposing side rails spaced from each other and an axle extending between said rails with a rumble strip cutting drum having a length of less than half the distance between the said rails and removably mounted on said axle adjacent one of said rails, the improvement including: a rumble strip motion wheel assembly including a piston wheel rotatably mounted in said assembly; said assembly pivotally mounted to said frame; and a connector between said assemble and said frame that can be adjusted in length so that said assembly can be pivoted to raise or lower said piston wheel in relationship to said rumble strip cutting drum in order to adjust the depth of cut of said cutting drum.

An improved rumble strip cutter including a frame having opposing rails spaced from each other and in substantially parallel relationship, said rails having opposing ends, a rumble strip cutter drum rotatably mounted on said frame at one end of said rails and adjacent one of said rails; including a pivotal connector adjacent the other end of said rails for pivotally connecting said frame to a tractor; a power input pulley rotatably mounted on said frame for supplying power to said rumble strip cutter drum; a belt for transmitting power from a power output source on a tractor to said power input pulley; and a rail length adjustment device on at least of one said rails to enable the tension on said belt to be adjusted.

BRIEF DESCRIPTION OF THE DRAWINGS

Having described generally the objectives and features of the present invention, a detailed description of a preferred embodiment of the invention will be described in conjunction with the following drawings, wherein:

FIG. 22 also shows the movable water spray bar on the right side of the device.

DESCRIPTION OF THE PREFERRED EMBODIMENTS

Figure 1A:
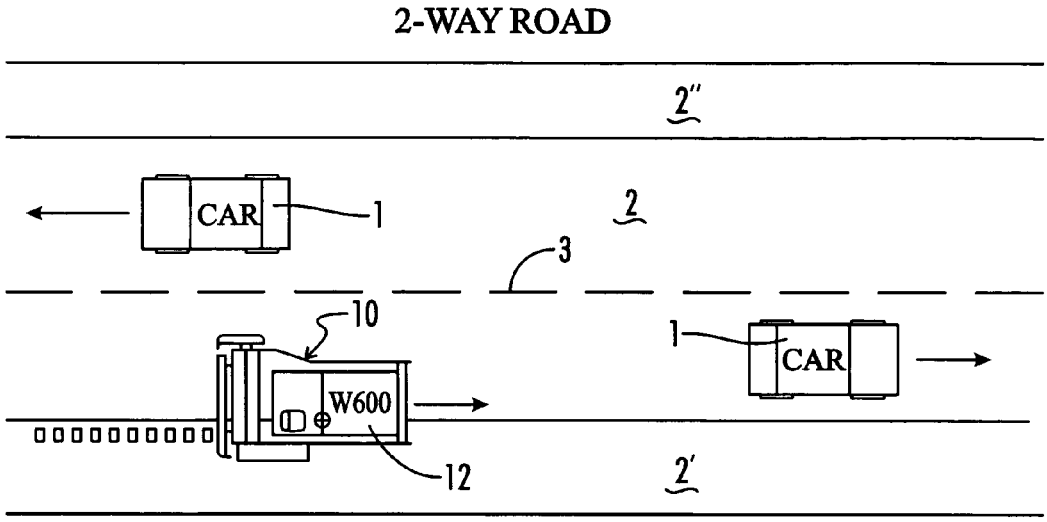
FIG. 1*a* illustrates generally the operation of the present invention on a two-lane highway.

Referring now to the drawings, wherein like numbers refer to like parts throughout, a preferred embodiment of the machine and method constituting the present invention will be described. The description is, however, not to be considered a limitation of the invention as set forth in the claims appended hereto.

Figure 1B:
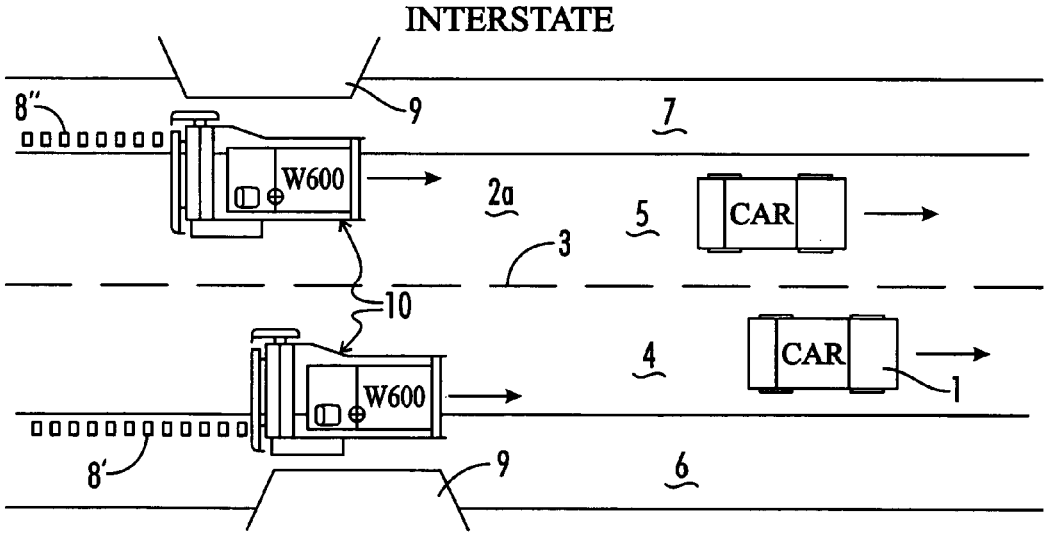
FIG. 1*b* illustrates the operation of the machine and method of the present invention on an interstate highway.

The environment in which the present invention operates is illustrated in FIGS. 1*a* and 1*b*. In FIG. 1*a*, a two-lane highway is shown with cars moving in opposite directions over a highway 2 on either side of a centerline 3. Outside the margins of the highway 2 are shoulders 2' and 2" on the right and left sides of the road respectively. In FIG. 1*a*, the rumble strip cutter 10 is shown on the right side of the road moving in the direction of travel of the car in the right hand lane. The rumble strip cutter 10 is mounted to a self-propelled vehicle 12 for driving the rumble strip cutting machine along the shoulder 2' of the highway 2. The self propelled machine 10 can be a variety of products which can be generally referred to in this context as a tractor. The specific machine that the preferred embodiment of the present invention is designed to attach to is a Wirtgen milling machine, Model No. W600DC, which is readily available in the marketplace from Wirtgen America, Inc., the assignee of the present invention with headquarters in Nashville, Tenn. However, the rumble strip cutter invention which is the subject matter hereof could be adapted to a variety of motorized vehicles such as tow motors, pavers, graders or just a simple tractor type machine that has a combustible engine for providing power to drive the tractor along the highway and also to provide a power output for driving the rumble strip drum of the present invention.

Referring now to FIG. 1*b*, there is illustrated the present invention in the particular circumstance to which the invention is most advantageous. Specifically, FIG. 1*b* illustrates an interstate highway, or a four-lane highway, which has two lanes of cars traveling in one direction and two additional lanes of cars traveling in an opposite direction. In FIG. 1*b*, cars 1 again are both traveling along highway 2*a* in lanes 4 and 5 respectively on either side of center line 3. Once again, the highway has right and left shoulders 6 and 7, respectively.

As shown in FIG. 1*b*, the machine 10 can be placed on either side of the highway to cut rumble strips in either the shoulder 6 or the shoulder 7. However, as can be seen generally from the layout of the machines shown on FIG. 1*b*, the machine that is cutting rumble strips on the right shoulder 6 has the drum mounted such that the rumble strips 8' are cut generally on the right hand side of the machine so that the machine can comfortably pass by obstruction 9 and still be able to cut rumble strips in the narrow shoulder. Likewise, when the machine 10 is positioned to cut rumble strips in the left shoulder 7 of the highway, the rumble strips 8" are cut with the cutting drum mounted on the left side of the machine so that the machine can continue to travel in the direction of travel of the cars 1 so that it will not be facing head-on to the direction of travel to the cars and yet still be able to cut rumble strips in the narrow portion of the shoulder 7 caused by the position of obstruction 9.

Figure 2A:
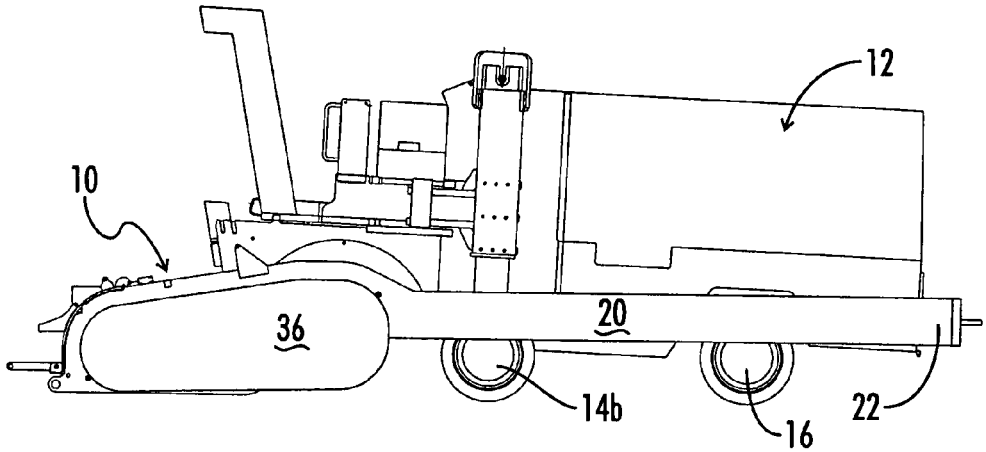
FIG. 2*a* is a side view of a milling machine with the rumble strip attachment connected thereto.
Figure 2B:
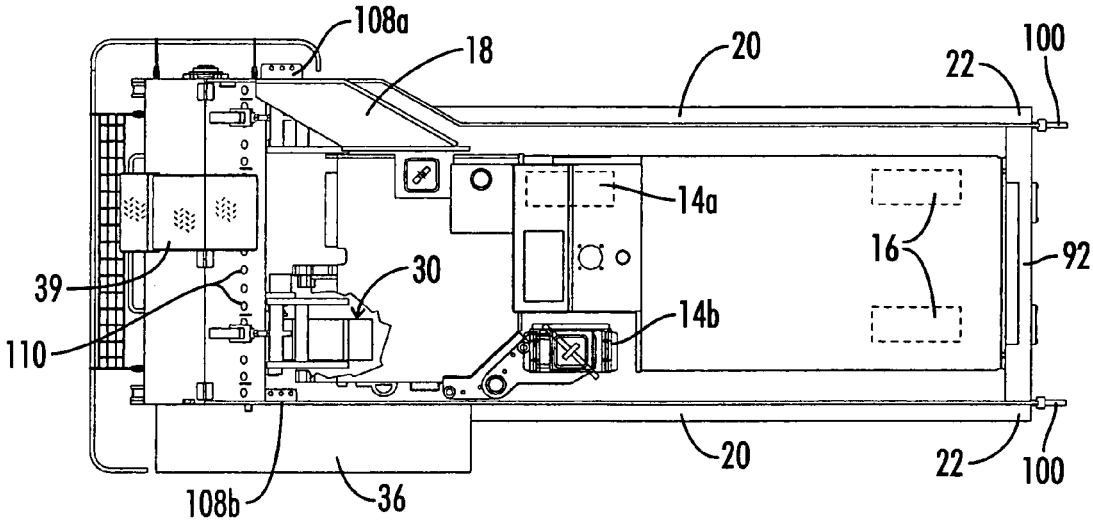
FIG. 2*b* is a top view of the machine and preferred embodiment of the rumble strip cutter with the piston wheel and cutting drum mounted on the right side of the machine.

Looking now at FIGS. 2*a* and 2*b*, there is a general illustration of the preferred embodiment of the improved rumble strip cutter 10. The preferred embodiment of the improved rumble strip cutter 10 is designed to attached to a milling machine and specifically to a Wirtgen model W600 milling machine sold by Wirtgen America Inc. of Nashville, Tenn. However, other types of motorized vehicles milling machines, tractors, graders and the like could be used as the vehicle for moving the improved rumble strip cutter along the edge of the highway to cut the rumble strips in the shoulder of the highway.

The tractor 12 includes rear wheels 14*a* and 14*b* along with front wheels 16 for guiding the tractor. The wheels 14*a* and 14*b* preferable are of a known structure that can be raised and lowered to lower and raise the height of the drum cavity of the milling machine that is directly behind the wheels 14*a* and 14*b*.

Suspension plates 18, which include a left side suspension plate 18*a* and a right side suspension plate 18*b* (see FIG. 9), are designed to be bolted to the side frame of the tractor 12. These suspension plates 18 could be formed integrally with the tractor 12 or may be added as an after market product. The design of the suspension plates is such that they provide brackets for the attachment of rods that carry the improved rumble strip cutter, details of which will be described hereinafter.

Figure 3A:
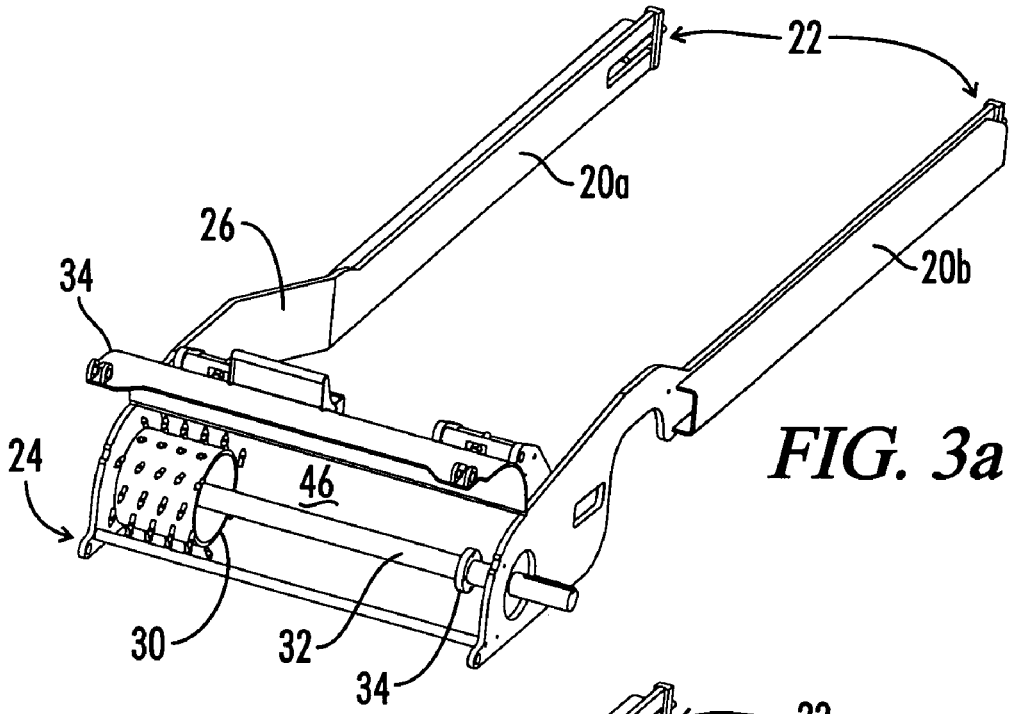
FIGS. 3*a* and 3*b* are perspective views of the rumble strip cutting device of the present invention with the cutting drum mounted on the left and right respectively sides of the frame.
Figure 3B:
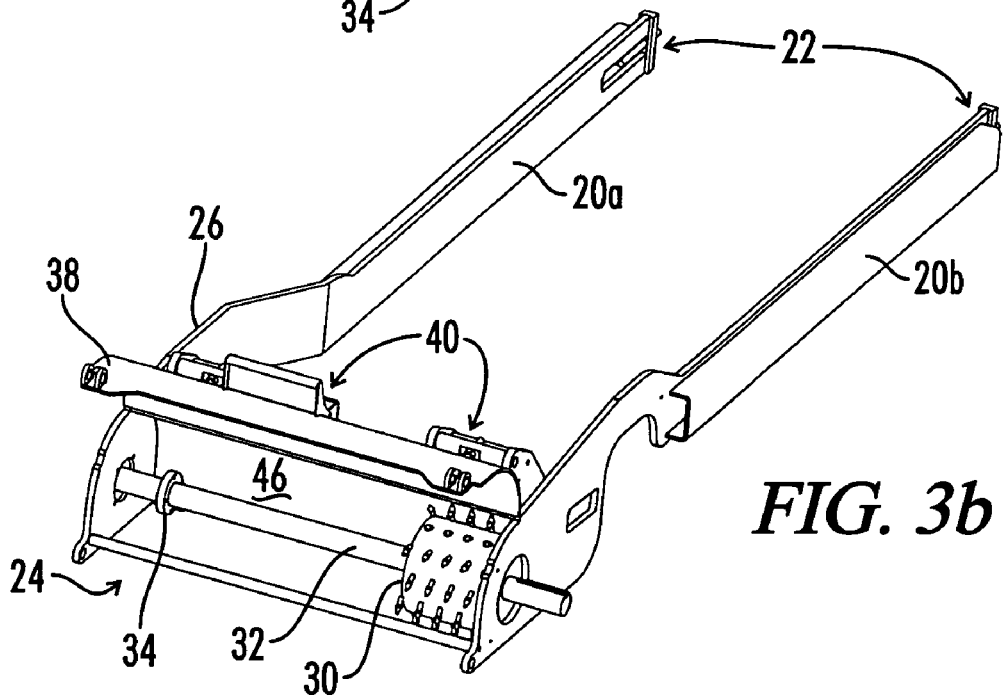

The improved rumble strip cutter 10 has a frame constructed of side rails 20 (left side rail 20*a* and right side rail 20*b*, as can be seen in FIGS. 3*a* and 3*b*), along with a cutter drum housing 46. The rails have opposing ends 22 and 24 (see FIGS. 3*a* and 3*b*). The ends 22 are connector ends for connection to the tractor 12. Preferably, these connector ends 22 are connected to the front of the tractor, but they can be connected at other places along the chassis of the tractor. The opposing end 24 of the improved rumble strip cutter includes a cutter drum housing 46 extending between and connecting those two ends to form the improved rumble strip frame.

In the preferred embodiment of the invention, the rail 22*a* has an offset 26 to facilitate the mounting of the rumble strip cutter to a Wirtgen W600 DC milling machine. To adapt to other milling machines or motorized vehicles for pulling the rumble strip cutter, the rail 20 may be differently configured in order to facilitate connection of the rumble strip cutter to the machine.

Inside the cutter drum house 46 is a rumble strip cutting drum 30. The rumble strip cutting drum is generally well known in construction and configuration, having an outer perimeter with cutter drum teeth mounted thereon and a rim type shape. The specifics of the cutter drum will be described in more detail in conjunction with the description of the invention as shown in FIG. 4.

Traversing the cutter drum housing is a rumble strip cutter drum axle 32 which has a pair of rumble strip cutting drum mounting flanges 34 spaced at opposite ends of the axle. Hingedly connected to the cutter drum housing 46 is a cutting drum housing closure 38 which has mounting steps on the back thereof. The mounting steps allow an operator to climb onto the tractor conveniently even with the improved rumble strip cutter attached to the machine. The cutting drum housing closure 38 can be opened to provide access to the cutting drum 30, axle 32 and flanges 34 for reasons as will be more apparent hereinafter.

Figure 4:
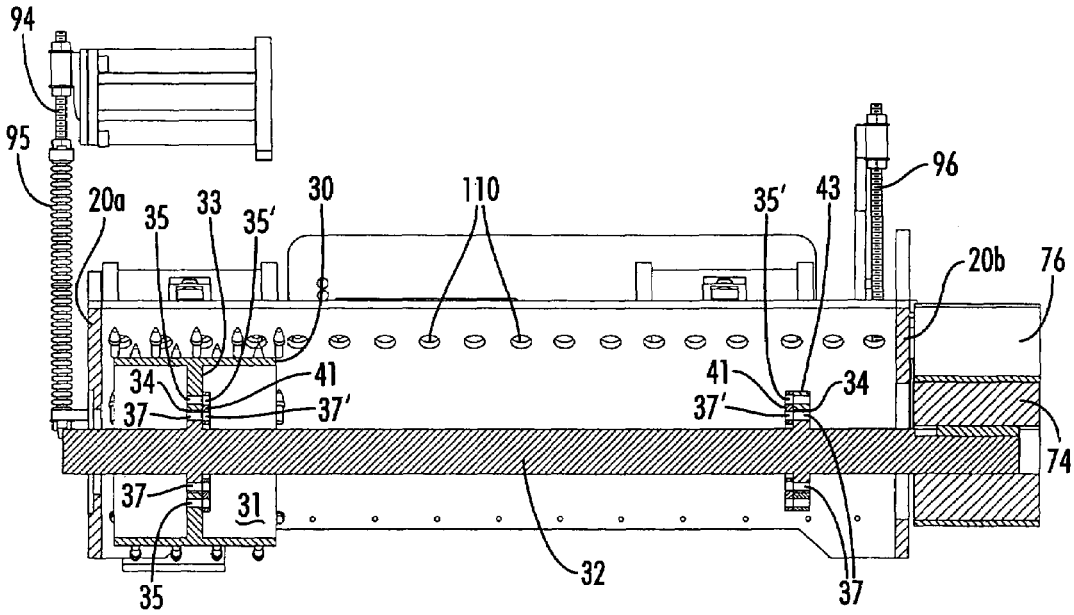
FIG. 4 is a cross sectional view of the rumble strip cutting drum and the mounting structure for that drum.

Looking at FIG. 4, the rumble strip cutting drum 30 is more clearly illustrated. As can be seen from FIG. 4, the rumble strip cutting drum 30 is cylindrically shaped having a hollow center 31 with an annular rib 33 protruding radially inwardly from approximately the center of the drum. The annular rib 33 is sized and shaped to mate with and fit over the mounting flange 34 in a snug fit. To attach the rumble strip cutting drum 30 to the axle 32, the annular rib 33 is positioned about the flange 34, and held in place by a mounting plate 41. The mounting plate 41 is shaped generally in the form of a disc with a center opening to fit about the diameter of the axle 32. The mounting plate 41 is split in half so that one half can be placed about one side of the axle 32 and the other half placed about the other side of axle 32. Once in place, the mounting plate is rotated so that holes 35 in the annular rib 33 and holes 37 in the mounting flange 34 align with holes 35' and 37' in the mounting plate 41. Next, bolts (not shown) are passed through the holes 35', 37' and screwed into tapped threads formed in holes 35 and 37 thus, the plate 41 transfers the power of the rotating axle 32 to the annular rib 33 of the drum 30 and causes the drum 30 to rotate so that the chiseled teeth on the drum will cut the rumble strips in the payment.

Looking at FIG. 4, the drum is shown mounted on the left side flange on the axle 32. The mounting flange 34 on the right side of the axle is covered by a protector plate 43 to keep the outer perimeter of the mounting flange 34 from becoming damaged because of flying debris inside the cutter drum housing. The protector plate 43 is bolted to the flange of 34 by another mounting plate 41. Once again the protector plate 43 has holes that align with the holes 35' 37' of the mounting plate 41 so that bolts (not shown) can be passed through the holes 35' 37' and screwed into the tapped threads inside the holes on the protector plate and the holes 37 spaced radially about the flange 34.

When it becomes desirable to shift the rumble strip cutter drum 30 from the left side of machine to the right side of the machine, the bolts that connect the protector plate to the mounting plate are unscrewed and the protector plate is removed. Similar to the mounting plate, the protector plate 43 is in two halves so that the two halves can be separated and moved from their position about the axle 32. Next, the bolts that connect the mounting plate 41 to the flange and rib of the drum are disconnected and the mounting plate on the left side of the machine is removed. At that point, the drum 30 can be moved axially off of the mounting flange 34 on the left side of the axle and slid down the axle 32 to the right until such time as it is positioned over the mounting flange 34 on the right side of the machine. The mounting plate 41 for the right side of the machine is then bolted onto the mounting flange 34 and the annular rib 33 by passing the bolts through the mounting flange into the tapped holes of the rib and flange respectively. Next, the protector plate 43 is mounted to the mounting flange 34 on the left of the machine to protect the outer surface of the mounting flange from damage and the machine is now enabled to operate with the cutting drum on the right side of the machine.

Referring now to FIGS. 5 through 8, the rumble strip motion wheel assembly 40 will be described. The rumble strip motion wheel assembly 40 includes a piston wheel 44 and piston wheel housing 42. The piston wheel 44 is a multi-sided wheel which is mounted in the wheel housing. As the piston wheel 44 rotates over the highway surface, when the wheel is resting on a flat portion of the wheel, the frame of the rumble strip cutter is at its lowest point, allowing the cutting drum to make its deepest cut. As the wheel rotates, it passes over the apexes between flat surfaces on the wheel, thus lifting the rumble strip cutter frame and raising the drum out of the depression or rumble strip that has been cut in the highway surface and moves the drum forward to a point where it will make the next rumble strip cut. Thus, the wheel 44 is referred to as a piston wheel because it transmits at a piston like, or up and down, motion to the rumble strip cutter frame thereby causing the rumble strip cutting drum 30 to move in an up and down motion as the machine is advanced over the highway. The up and down motion that is transmitted to the rumble strip cutting drum occurs in conjunction with a forward motion of the rumble strip cutter so that as the rumble strip cutting drum (which will be driven in a continuous rotating motion) comes in contact with a road surface and the frame is lowered, the cutting drum will cut a rumble strip in the road surface and as the piston wheel is driven to move the frame forward, the rumble strip cutting drum is lifted out of the rumble strip and moved forward to the point where the next rumble strip is to be cut and the frame is lowered because of the action of the wheel to cut the next rumble strip.

Figure 5:
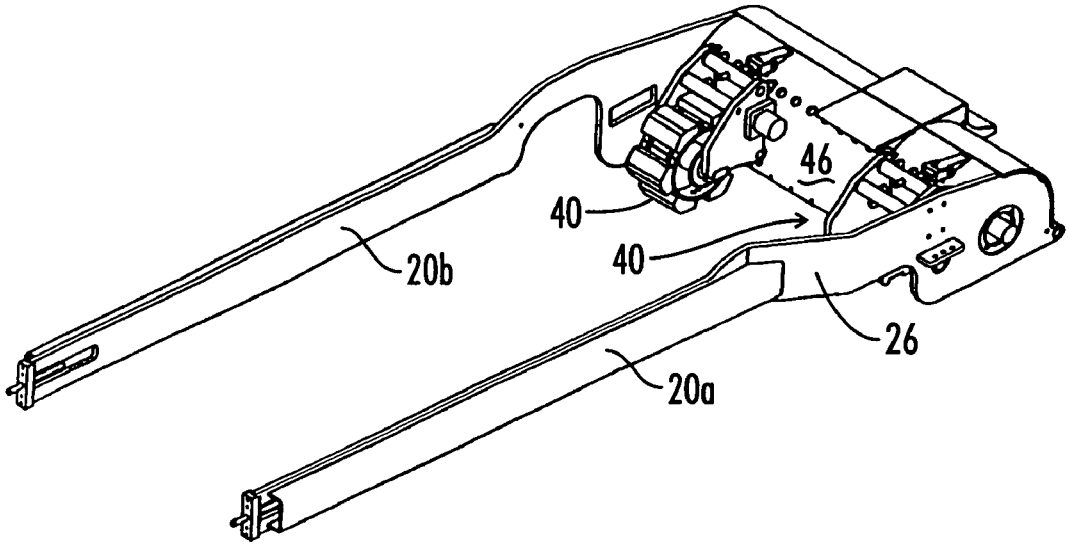
FIGS. 5 and 6 are perspective views of the device of the present invention with the piston wheel illustrated as mounted on the left and right sides of the machine respectively.
Figure 6:
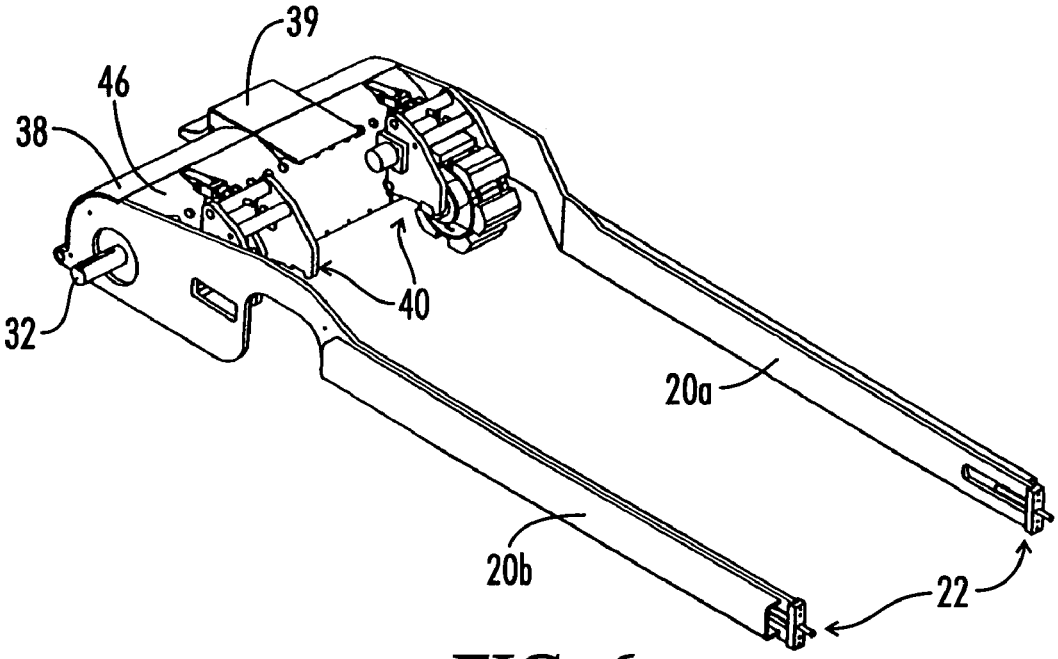

As can be seen from FIGS. 5 and 6, the piston wheel 44 can be mounted on either the left side of the frame or the right side of the frame. The piston wheel 44 is moved to the side of the frame on which the rumble strip cutting drum is mounted to impart the up and down motion to the rumble strip cutting drum. The opposite side of the frame remains relatively stationary so that the axle 32 actually has an arcuate up and down motion. This arcuate motion of the axle 32 also transmits a slightly arcuate up and down movement to the cutting drum 30. This arcuate movement of the drum 30 is beneficial because the cutting process begins with the inner edge of the drum and as the drum is lowered the cutting process moves toward the outer edge of the drum. Thus, the need for power to drive the drum is gradually increased as the drum is eased into the full cut position. Stated in the negative, there is no need to cut across its full length of the drum to the same depth at the same time. This motion of the cutting drum allows the rumble strips to be cut easier and does not wear down the machine in quite the same fashion as a process which attempts to execute a cut parallel to the road surface.

Figure 7:
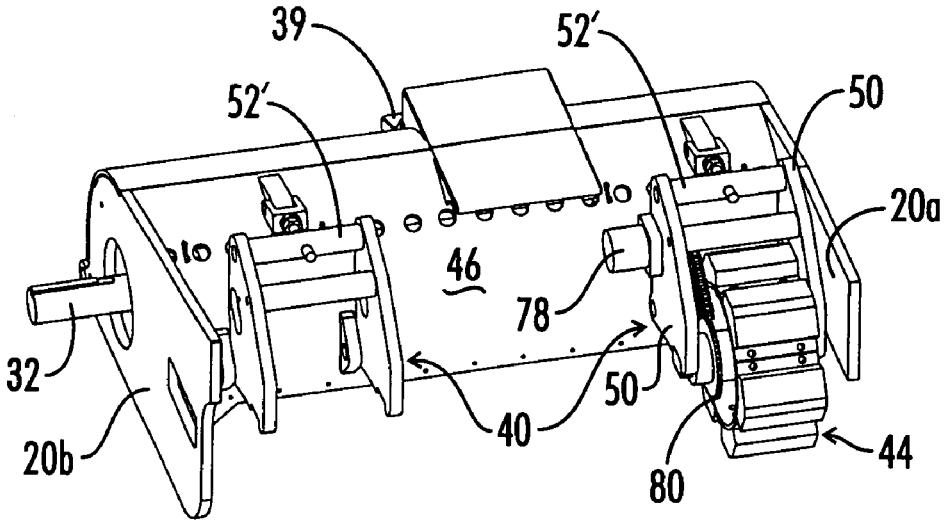
FIGS. 7 and 8 show perspective views of the piston wheel mounting assembly and drive motor for driving the piston wheel.
Figure 8:
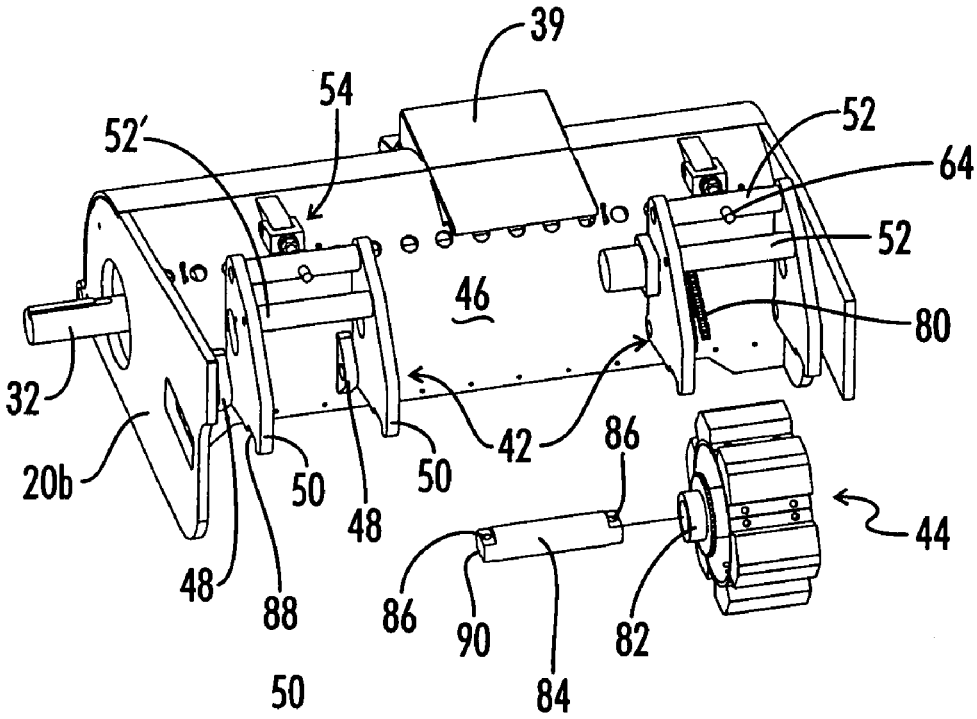

Looking now at FIGS. 7 and 8, the rumble strip motion wheel assembly 40 is illustrated in greater detail, and from these drawings the method for switching the piston wheel 44 from one side of the machine to the other will be described.

The drum housing 46 extends between the two side rails 20*a* and 20*b* and serves as a chamber for the rumble strip cutting drum 30. The axle 32 extends through the housing 46 as has been previously described. The wheel housings 42 on either side of the frame each include a pair of panels 50. The panels 50 are pivoted mounted to the housing 46 by mounting plates 48. The panels 50 are held in a spaced fixed relationship relative to each other by the spacers 52. Spacers 52, in this instance, are shafts that are mounted to opposing panels 50 to hold the panels in a spaced fixed (relative to each other) relationship. The wheel shaft 84 also serves as a spacial support of opposing panels 50.

Figure 16:
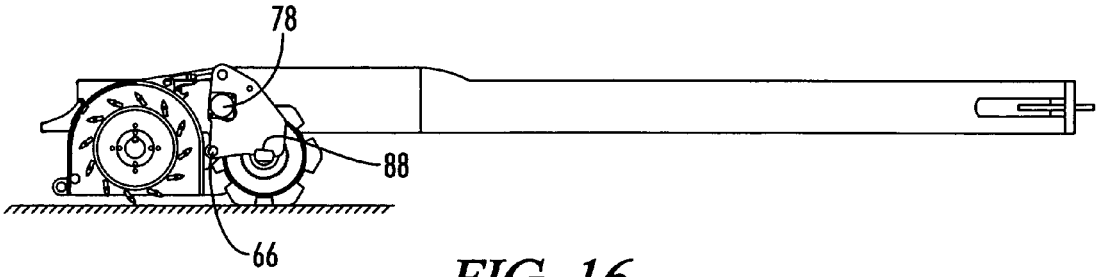
FIGS. 16 and 17 illustrate an adjustment feature which allows the depth of cut of the cutting drum to be easily adjusted.
Figure 17:
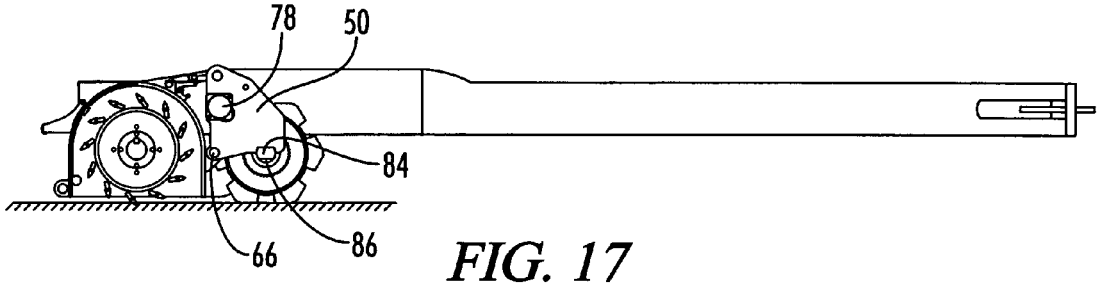
Figure 18:
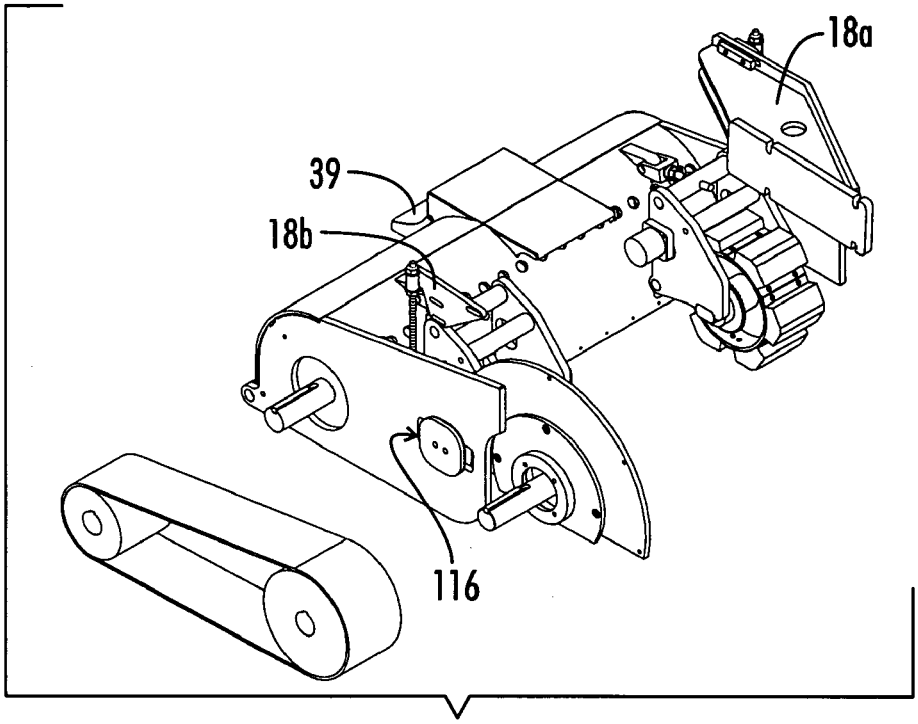
FIGS. 18 and 19 illustrate the power train drive system for driving the rumble strip cutter of the present invention.
Figure 19:
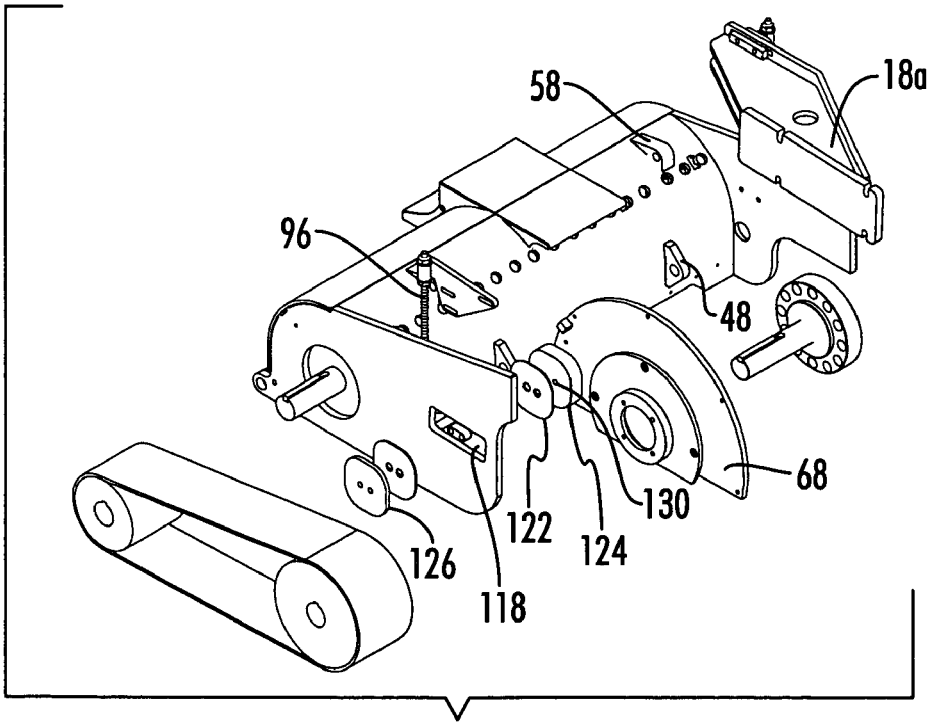

The invention includes a cutting depth adjustment mechanism 54 (best illustrated in FIGS. 9, 16 and 17) which includes a U bolt 56 attached to a boss 58 protruding from the housing 46. The U bolt 56 is pivotally connected to the boss 58 by a pivot connector 60, and a pivot shaft is pivotably mounted in bushings between opposing panels 50. Rotationally mounted rod 62 extends from the U bolt and passes through a tapped hole in the pivot shaft 52'. A jam nut 64 is screwed onto the rod 62. The jam nut can be loosened and rod 62 turned so that the pivot shaft moves relative to the U bolt 56 to change the distance "d" between the boss 58 and the pivot shaft 52' (see FIGS. 16 and 17), which will rotate the rumble strip motion wheel assembly about pivot point 66 (see FIG. 10). When the rumble strip motion wheel assembly rotates in a counter clockwise direction about pivot point 66, the distance "d" is reduced and the cutting drum is lowered to a greater cutting depth. When the nut 64 on the rod 62 is adjusted in a direction to lengthen the distance "d" between the pivot shaft 52' and the U bolt 56, the rumble strip motion wheel assembly 40 rotates in a clockwise direction as seen in the FIGS. 6, 9, 10 and 17. When that motion of the rumble strip motion wheel assembly occurs, the rumble strip cutting drum 30 is raised so as to reduce the depth of the rumble strip cut.

Figure 9:
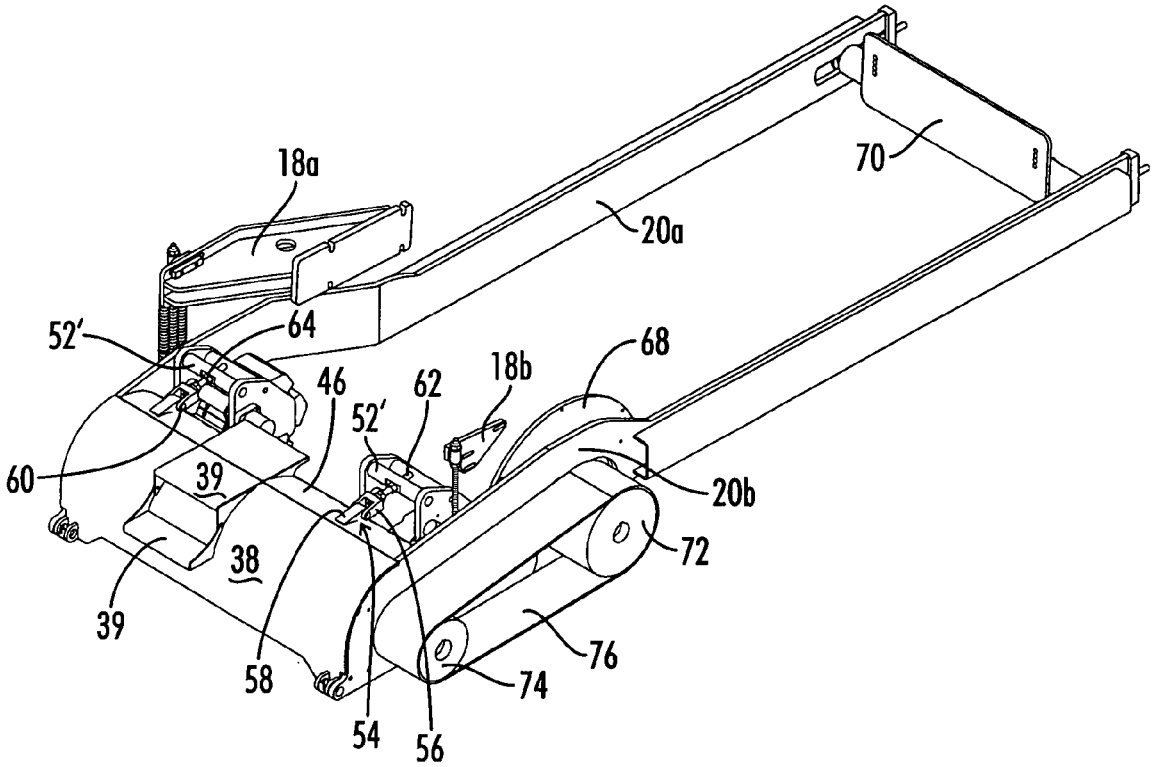
FIG. 9 shows a perspective view of the preferred embodiment of the device and illustrates in particular the mounting brackets for mounting the device to a transport vehicle and the power train pulley and belt structure of the invention.
Figure 10:
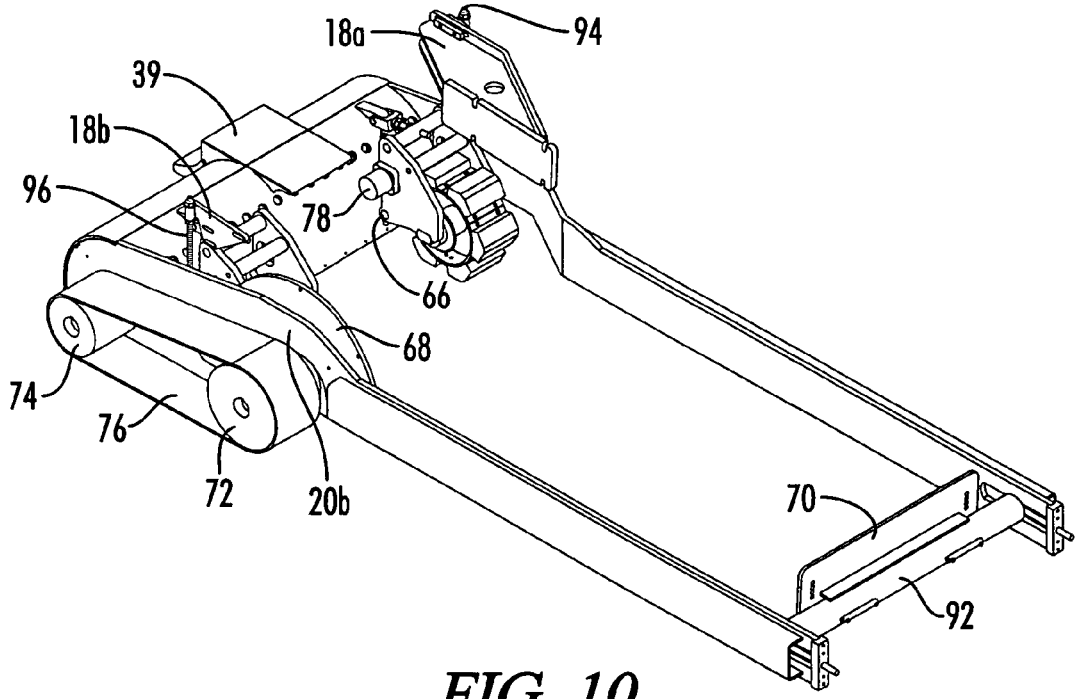
FIG. 10 shows a perspective view of the machine that is shown in FIG. 9 taken from a different angle.

FIGS. 9 and 10 illustrate the drive train that powers the rumble strip cutting drum. A drive output support plate 68 is provided for attachment to the tractor 12. The support plate 68 carries a power transfer flange 98 that attaches to the power output source of the tractor 12. The flange 98 has an output shaft that is connected to a drive output pulley 72; thus, power from the tractor 12 drives the pulley 72. A drum drive input pulley 74 is mounted to the axle 32 and the drive output pulley 72 is connected to and transmits power to the drum drive input pulley 74 via the belt 76. With this drive train, power is supplied to the axle 32, which provides the power to drive the rumble strip cutting drum 30 attached thereto.

In order to keep the piston wheel 44 from sliding along the pavement, the wheel is driven through via power from a piston wheel drive motor 78. The piston wheel drive motor 78 is mounted on one of the plates 50. As can be seen in FIG. 10, when the piston wheel is mounted on the left side of the machine, the piston wheel drive motor 78 is mounted on the inside plate 50, and as is illustrated as FIG. 5, when the piston wheel is mounted on the right side of the frame, the motor 78 is on the inside plate 50 of the right hand assembly. A hole in the plate 50 allows a shaft from the motor to extend to the space between the two plates 50 and a sprocket is provided on that shaft so that a chain 80 can be fitted about the sprocket on the motor output and the other end of the chain can be looped over a sprocket 82 mounted on the axle of the wheel 44. Thus, as the motor 78 provides a power output through a shaft bearing a sprocket, the chain will transmit the rotational power to the wheel via a sprocket mounted on the axle of the wheel 44.

To attach the piston wheel 44 to the rumble strip motion wheel assembly 40, there is an axle 84 extending through the hub of the wheel. The axle 84 has flats 86 on either end and those flats fit within keyways 88 on the underside of the plates 50. The flats have holes passing through them and bolts (not shown) are passed through the holes in the flats at the ends of the axle 84 and screwed into threaded holes in the underside of the plates 50 at keyways 88. Thus, the axle is mounted to the wheel assembly and holds the wheel in place so that it can be driven to provide the up and down motion to the frame.

When it is time to shift the piston wheel from one side to the other, the bolts attaching the axle 84 to the plates 50 are loosened, and the piston wheel 44 is shifted to the other rumble strip motion wheel assembly 40. When the wheel 44 is shifted, it is rotated about its vertical axis 180 degrees so that the sprocket 82 is on the inside of the frame. The flats 86 of the axle 84 are then put in position in the keyways 88 on the other assembly. Bolts are passed through the holes 90 in the flats into tapped holes in the face of the keyways 88 and connected so that the axle is held in place. Prior to connecting the axle, the sprocket chain is passed over the sprocket 82 and the piston wheel drive motor 78 is moved from one assembly to the other and remounted on the inside plate 50 of the other assembly. The shaft of the drive motor 78 will pass through a hole in the plate 50 and the sprocket on the shaft will be positioned to receive the chain about the sprocket and transfer the power from the motor to the wheel 44.

The drive motor 78 is a hydraulic drive motor and because the motor has been rotated 180 degrees about a vertical axis to be mounted on the inside plate 50 of the other wheel assembly 40, in order to run the wheel in the proper direction, the direction of the motor will have to be reversed. In that case, the input and output hoses for the hydraulic fluids driving the motor will be switched so as to drive the motor in an opposite direction and therefore drive the wheel 44 in a proper direction.

Figure 11:
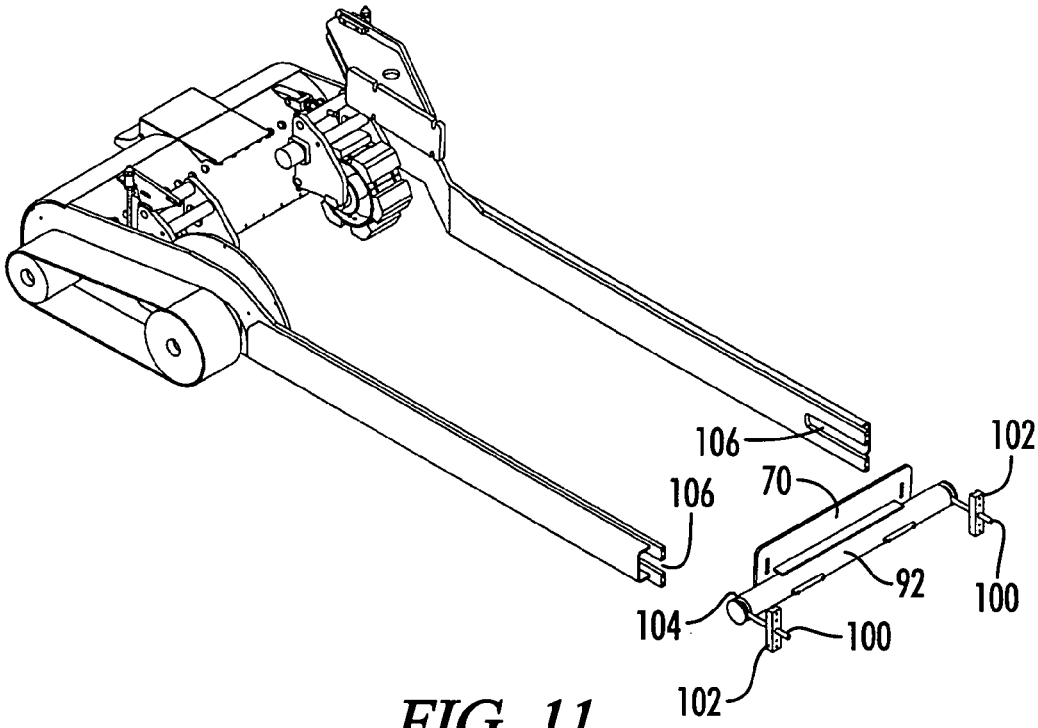
FIG. 11 shows the device with the mounting assembly that enables the tension on the drive belt to be adjusted.
Figure 12:
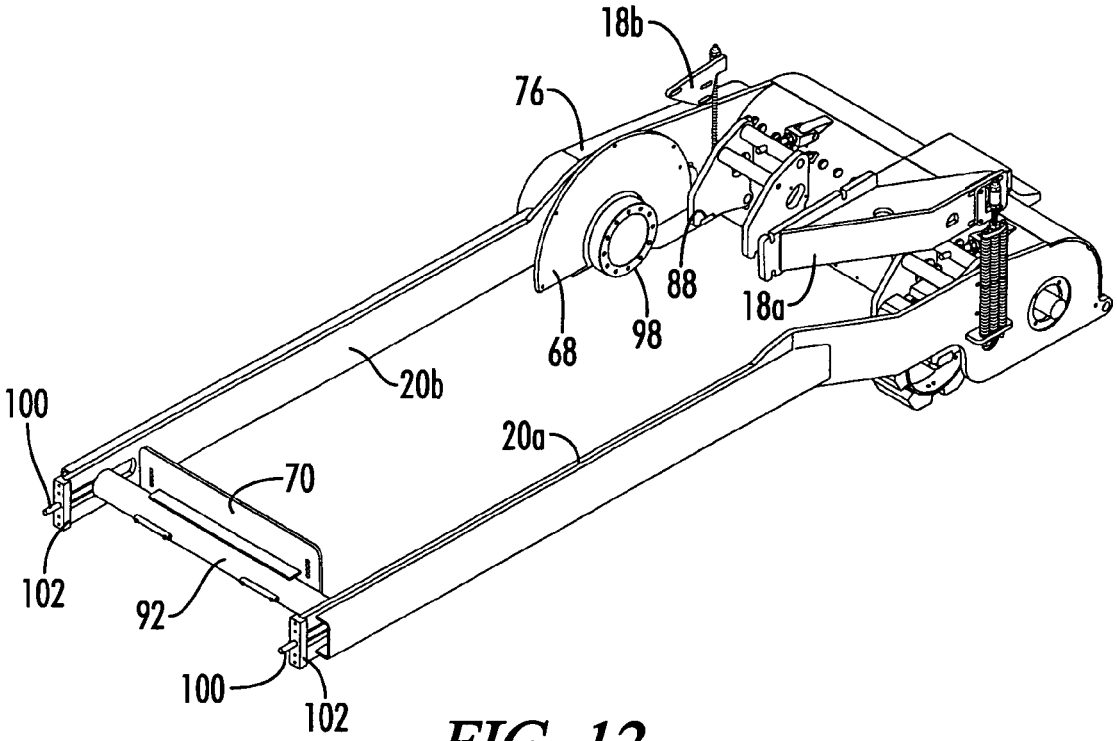
FIGS. 12 and 13 shows in greater detail yet another perspective view of the machine.
Figure 13:
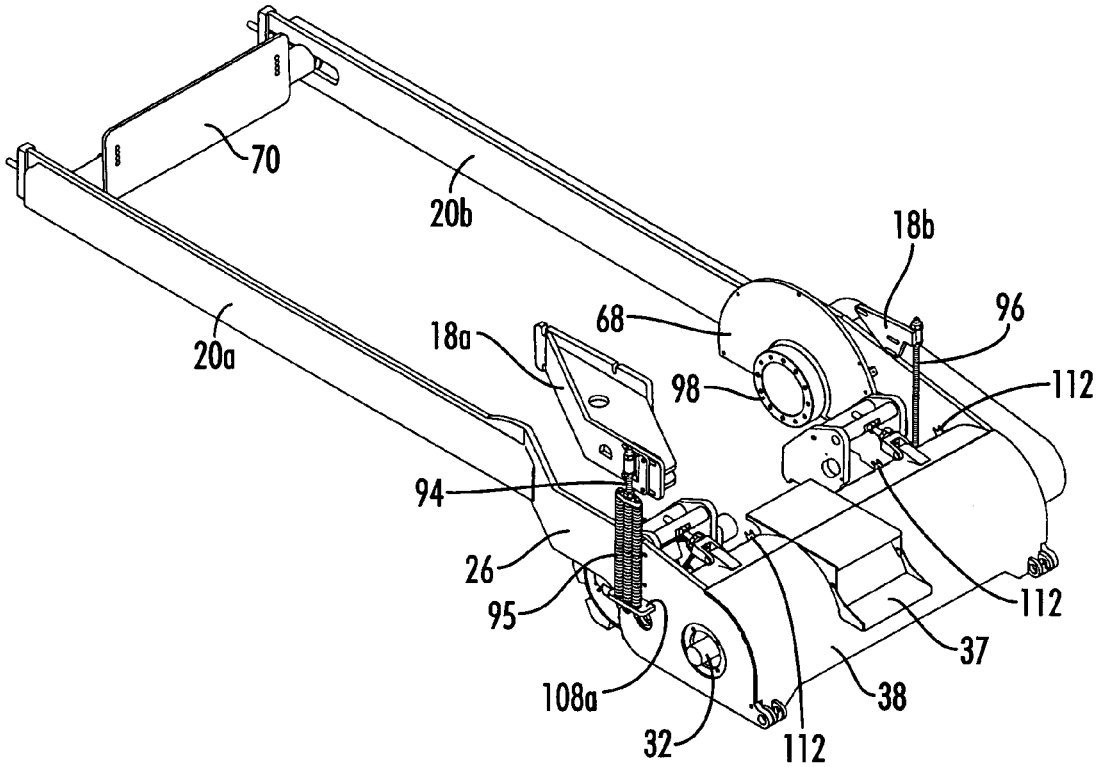

Referring now to FIGS. 10 and 11, another feature of the present invention will be described. As can be seen from FIGS. 10 and 11, a front mount plate 70 is provided which is designed to connect to the front of the tractor 12. The front mount plate 70 has a beam 92 welded thereto. The beam 92 extends across the tractor 12 and the ends of the beam 92 can be connected to the rails 20. As can be seen in FIGS. 11 and 12, threaded take up rods 100 extend through take up blocks 102. The take up blocks are mounted on the connection ends 22 of the rails 20 and thread into holes passing through opposite ends of the beam 92. The opposite ends of the beam 92 also include grooves 104 that fit within slots 106 in the connecting ends 22 of the rails 20. Thus, by screwing the take up rods 100 in one direction, the rails 20 will move forward relative to the chassis of the tractor 12 to reduce the distance between the two pulleys 72 and 74 to loosen the tension on belt 76. More importantly, if the tension on the belt 76 gets slack, the take up rods 100 can be rotated in an opposite direction to move the rails 20 in a rearward direction relative to the tractor and therefore increase the tension on the belt 76 passing over the pulleys 72, 74 and prevent any slippage in the transmission of power from the power output source on the tractor 12 to the cutter drum 30.

Referring now to FIGS. 13 through 15 and 18 through 23, additional features of the invention will be described. Specifically, looking at FIG. 13, there is illustrated the unique connecting structure between the frame of the rumble strip cutting machine of the present invention and a tractor. As can be seen, the suspension plates 18*a* and 18*b* are designed to connect to either side of the tractor. Attached to the suspension plates 18 is a pair of rods, lifting/pressure rod 94 and support rod 96. These rods are sometimes referred to as connectors and serve a function of connecting the rumble strip cutting machine frame to a tractor. The lifting/pressure rod 94 is attached to suspension plate 18*a* through a sleeve (see FIGS. 20 and 21) with attaching nuts 138 on either side of the sleeve. An expansion spring 95 fits over rod 94. Mounted on top of the expansion spring 95 is a tension cross plate 134. The cross plate is held down by a nut screwed onto the rod 94 and seated above the plate 134. The rod 94 passes through support rod plate 108*a* and a support nut 140 is fit on the underside of the plate 108*a* and screwed onto rod 94. Thus, the rod 94 is fixed relative to the tractor 12 by its connection through the plate 18*a* to the tractor and is fixed relative to the outside rail 20*a* of the rumble strip cutting frame so that when the rod is lifted the frame will be lifted. However, the frame can move up and down relative to the rod against the pressure of expansion spring 95. Thus, the expansion spring 95 applies downward force on the rail 20*a* to force the rumble strip cutting drum down against the pavement and make a better cut. The tension cross plate 134 also has mounted on it a pair of guide rods 136 which extend through holes in the plate 108*a*. Those guide rods also have expansion springs coiled about them to apply addition pressure against the top of plate 108*a* to help keep the cutting drum 30 pressed against the road surface in order to make a better cut and reduce the possibility of the drum not fully penetrating the surface as the rumble strip is being cut. In softer material, spring pressure can be completely released. Spring pressure is adjusted by adjusting a nut directly on top of cross plate 134.

The rod 96 is fixed relative to both the tractor 12 and the rumble strip cutting frame by the connection of the rod at either end to the suspension plate 18*b* at the top and 108*b* at the bottom. Thus, as can be seen in FIG. 21 for example, a configuration in which the drum is mounted on the near side of the rumble strip cutter as shown in the illustration, the side of the frame in which the rod 96 is employed is fixed relative to the tractor 12 and has very little movement whereas the side of the frame that is connected to the tractor 12 through the rod 94 is allowed to move in an up and down motion relative to the tractor as the piston wheel 44 rotates to raise and lower the frame of the rumble strip cutter on the side where the rumble strip cutting drum is mounted.

Figure 21:
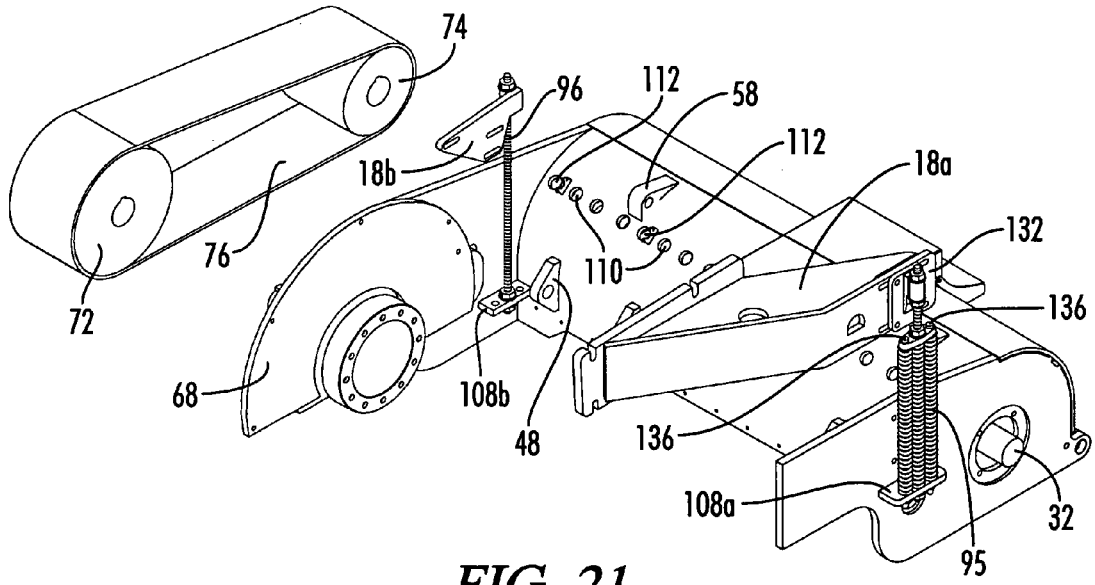
FIGS. 21 and 22 illustrate the mounting bolts in one configuration and in a reverse configuration for mounting the device of the present invention to a motorized vehicle.
Figure 22:
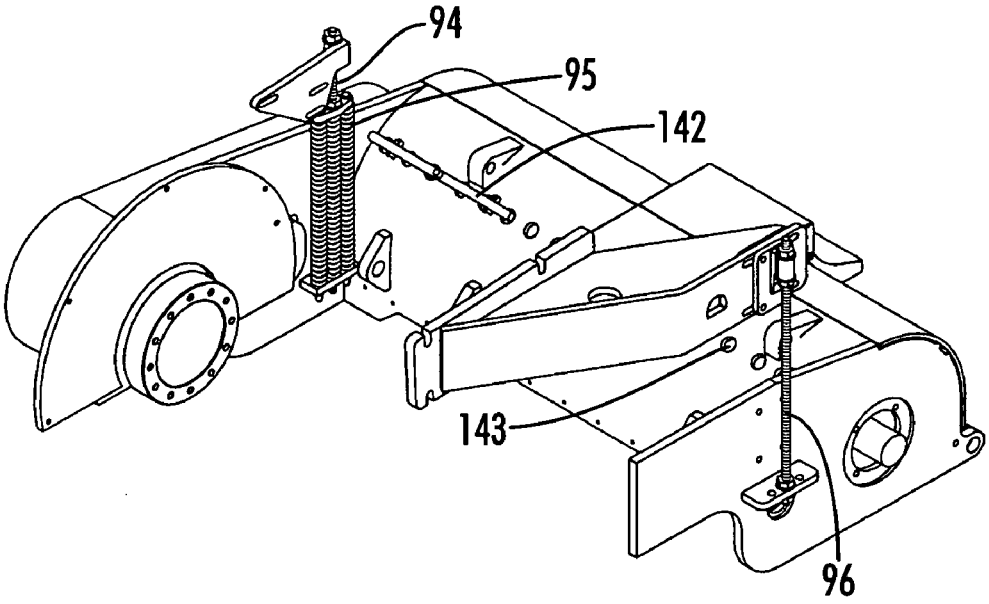

When the rumble strip cutting drum is moved to the other side of the rumble strip cutting frame, along with the piston wheel 44, the mounting of the rods is reversed so that rod 96 will be on the near side of the frame as illustrated in FIG. 22 and the rod 94 will be on the far side of the frame. As can be seen in FIG. 21, the support rod plate 108*b* has three holes in it to allow the three rods that are a part of the rod system 94 to pass through those holes to apply downward pressure on the system when the system is configured for cutting rumble strips on the power input side of the system.

Figure 20:
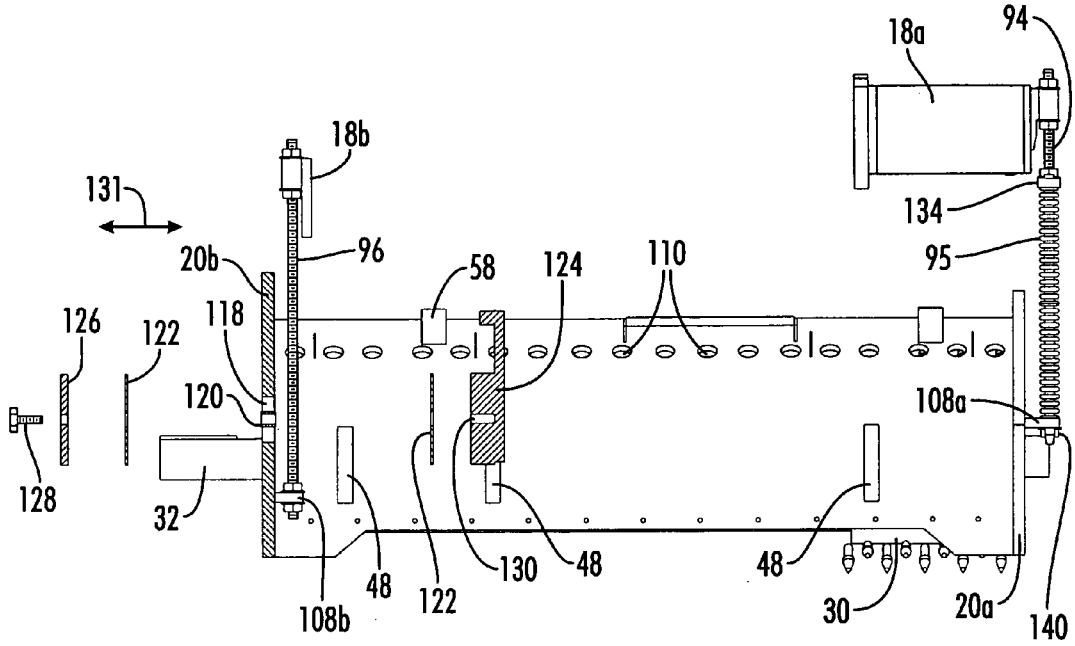
FIG. 20 illustrates a cross sectional view, a feature of the present invention which allows the device to move relative to the machine that is driving the device without damaging the rumble strip cutter during rumbling operation, yet provide support of the rumble strip cutter frame laterally and provide pick-up support when raising the machine out of the cutting mode.

FIG. 20 is another illustration of the configuration show in FIG. 21. As can be seen in FIG. 20, the drum 30 is mounted on the right side of the machine as illustrated and the rod 94 is likewise on the right side of the machine with the rod 96 on the left side of the machine. When the drum 30 is moved to the left side of the machine, the rods will be switched so that the frame of the rumble strip cutting machine will be fixed relative to the tractor through the support plate 18*a*, and the left side of the machine will be allowed to raise and lower relative to the tractor 12 as the piston wheel rotates to raise the lower the drum 30 in order to cut the rumble strips in their spaced relationships.

Since the power input side of the machine never changes, it is necessary to accommodate rocking motion of the rail 20*b* when the cutter drum 30 is mounted adjacent the rail side 20*a*. Further, when the cutter drum 30 is mounted adjacent the rail side 20*b*, an accommodation must be made to allow the rail 20*b* to move in an up and down motion without impairing the power input to the cutter drum. FIGS. 18, 19, 20 and 21 illustrate these features of the invention. The rail 20*b* on the drive train side of the machine is provided with an elongated channel 118 having a height size to allow some movement of the rail 20*b* in an up and down motion over spacer 120. Nylon wear pads 122 are placed on either side of the rail 20*b* and an anchor plate 124 is on the inside of the rail 20*b* and fixedly attached to the drive output support plate 68. The inside pad 122 fits between the anchor plate 124 and the inside surface of the rail 20*b*. A retaining plate 126 is on the outside of the rail 20*b* and the outer nylon wear pad 122 is fitted between the outside surface of the rail 20*b* and the retaining plate 126. The spacer 120 has a length slightly greater than the width of the rail 20*b* and the retainer plate 126, the pads 122, the spacer 120 and the anchor plate 124 all have holes through them with the holes 130 in the anchor plate 124 being threaded. Bolts 128 pass through the holes in the plates, pads and spacers to hold the frame loosely connected to the tractor 12. Using this structure for connecting the frame of the rumble strip cutting machine to the tractor 12, the rail 20*b* is allowed to move in a rocking motion as represented by the arrows 131 (see FIG. 20) when the drum is mounted on the right side of the machine (as seen in FIG. 20). Because the frame moves up and down on the right side, and the relative height of the frame on the left side is fixed because the rod 96 is fixed relative to the tractor, a rocking motion will occur in the rail 20*b*. By having the spacer 120 being slightly longer than the width of the rail 20*b*, the rail 20*b* will be allowed to move between the plates 124 and 126. The pads 122 will prevent wear on the inner surfaces of the plates 124, 126. This assembly also provides lateral support for the rear of the rumble strip cutter frame, regardless of whether the machine is cutting on the left or right side.

When the machine is configured so that the cutting drum 30 is on the left side of the machine, the rods 94 and 96 will be swapped and the rail 20*a* will be in a fixed position relative to the tractor 12, but the flexibility of the rod will allow the rocking motion of the rail 20*a* to occur freely. On the other hand, with the drum 30 mounted on the left side of the machine, the rail 20*b* must be allowed to move up and down as the rotation of the piston wheel causes the frame to move up and down so that the rumble strip drum can cut the rumble strips. The height of the channel 118 allows the rail 20*b* to move up and down over the spacer 120 with the anchor plate 124 and retaining plate 126 holding the rail 20*b* adjacent the side of the tractor 12. At the same time, the rail 20*b* is allowed to move up and down as the piston wheel rotates over the pavement. Likewise, the rod 94 when mounted on the left side of the machine, applies downward pressure on the drum to make a better cut and also allows the movement of the frame in an up and down motion relative to the tractor 12.

Figure 14:
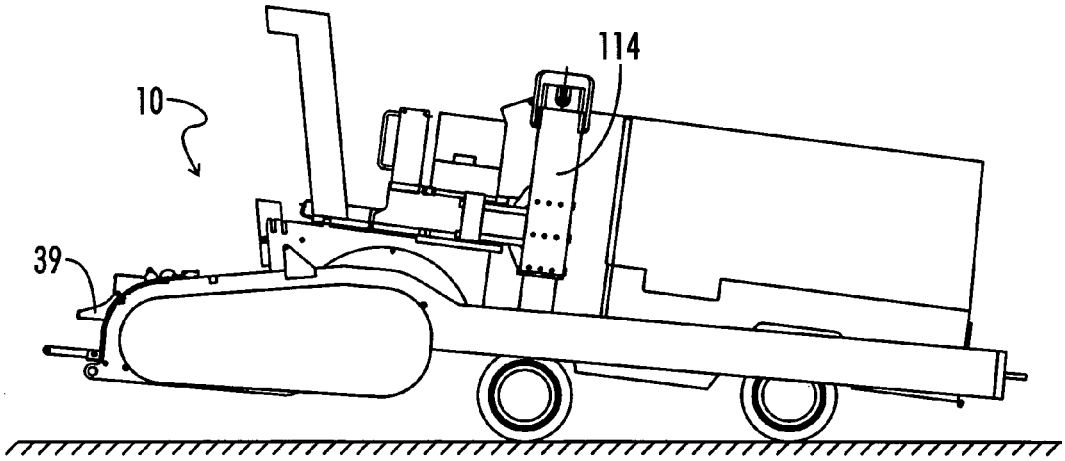
FIG. 14 shows the device of the present invention mounted on a milling machine with the rear legs of the milling machine extended so as to lift the rumble strip cutting device out of engagement with the road shoulder.
Figure 15:
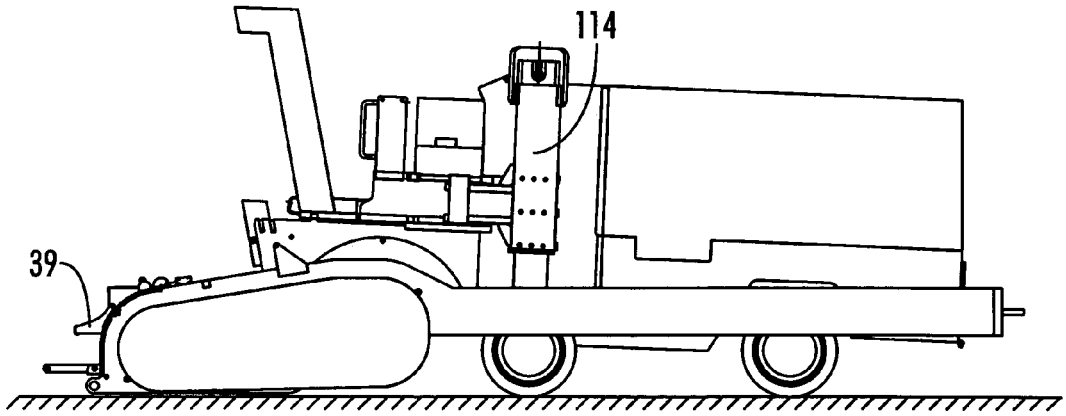
FIG. 15 shows the rumble strip cutting device in the present invention mounted on road milling machine with a rumble strip cutter in the operating position.

When it is time to move the rumble strip cutter from one job site location to another, it is desirable to raise the frame of the machine out of engagement with the highway surface. Illustrated in FIGS. 14 and 15 are views of the machine in these two separate positions. In FIG. 14, the telescoping wheel support 114 for the rear wheels of the tractor 12 are extended to raise the back of the tractor 12. When the back of tractor 12 is raised, and the rumble strip cutting machine of the present invention is attached to the machine in the manner as previously described, the rods 94 and 96 lift the machine off the ground as is shown in FIG. 14. Upon arrival at the new job site, the telescoping wheel support 114 is lowered and the rods 94–96 allow the rumble strip cutting machine of the present invention to be placed on the road surface as shown in FIG. 15.

Figure 23:
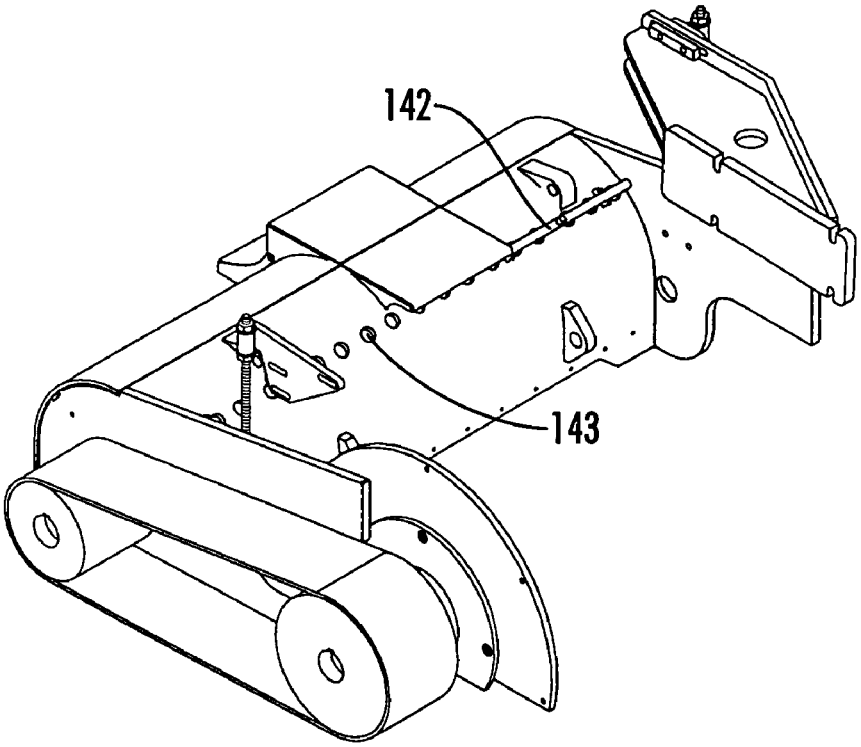
FIG. 23 shows the water spray bar of the present invention on the left hand side of the device and illustrates the ability to move the water spray pipe.

FIGS. 22 and 23 illustrate yet another feature of the present invention. FIG. 23 illustrates the machine set up for cutting rumble strips on the left side of the machine. As can be seen, the rod 94 is mounted on the left side of the machine and the rod 96 is on the right side of the machine. A water spray bar 142 is mounted on the left side of the machine when cutting on the left side and, as can be seen in FIG. 22, on the right side of the machine when cutting on the right side of the machine. The water spray bar has nozzles that fit through the holds 143 and water from a tank carried on the machine is sprayed into the rumble strip cutting chamber to reduce dust during the process. When the rumble strips are cut on one side of the machine, the spray bar is mounted on that side of the machine and when the system is reconfigured to have the rumble strip drum on the other side of the machine the spray bar is likewise moved. Clips are provided to mount the spray bar in the appropriate location.

Figure 24:
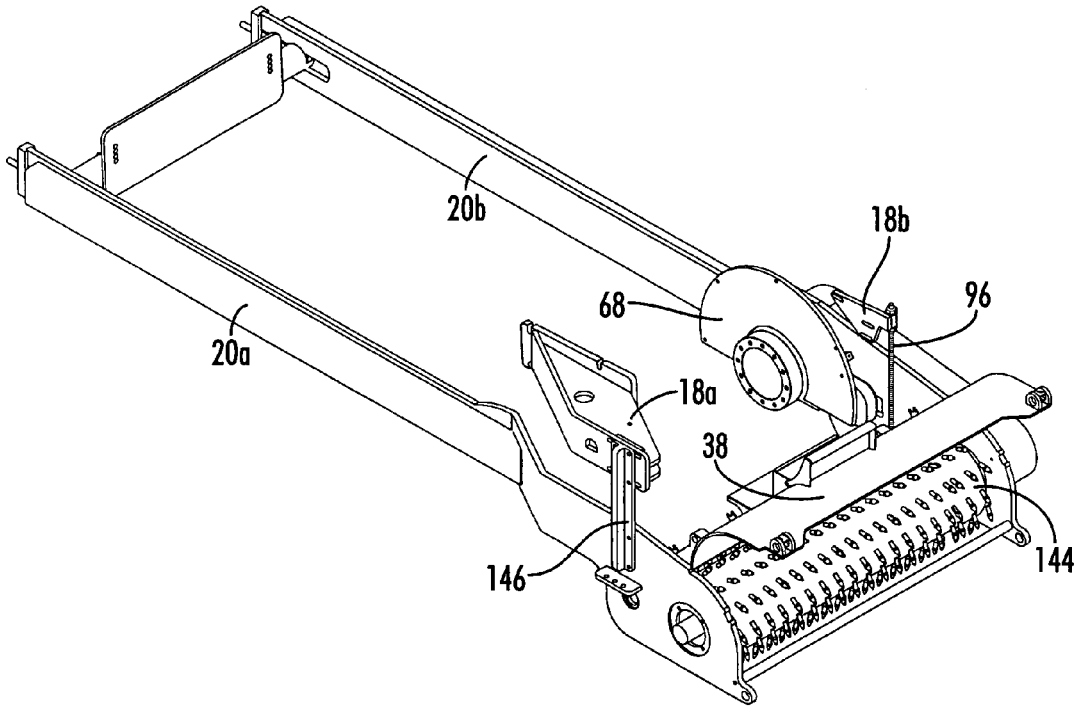
FIG. 24 illustrates the machine configured with a texturizing drum that can be used to texturize a road surface.

Finally, the machine is designed to be configured so as to carry full width milling drum for texturizing or smoothing ruff surfaces. Such a configuration is illustrated in FIG. 24. In that configuration, a full width milling drum 144 is mounted on the axle 32. In order to have the full width milling drum mounted for a level cut on the road surface, a brace 146 is mounted between frame rail 20*a* and the support plate 18*a*. Thus, with the rod 96 and the brace 146, a fixed configuration is established between the tractor 12 and the frame of the device so that the full width milling drum will be held against the road surface and perform its desired function. In this configuration, obviously the piston wheel is removed so that the full width milling drum is simply carried along behind the tractor 12 to perform the texturizing or smoothing function of the machine.

Although there have been described particular embodiments of the present invention of a new and useful Modified Rumble Strip Cutter, it is not intended that such references be construed as limitations upon the scope of this invention except as set forth in the following claims.

What is claimed is:

1. An improved rumble strip cutting machine including:

a. a pair of spaced apart, generally parallel rails having opposing ends with one end of said rails having connectors for connection of said improved rumble strip cutting machine to a tractor and the opposite ends of said rails being connected by a cutting drum housing;

b. an axle extending through said housing;

c. a power input source connected to said axle to rotatably drive said axle;

d. a rumble strip cutting drum removably mounted to said axle adjacent one of said rails; and e. a mounting structure adjacent the other of said rails whereby said rumble strip cutting drum can be removed from the position adjacent said one of said rails and attached to said mounting structure adjacent said other of said rails.

2. The improved rumble strip cutting machine of claim 1, further including a piston wheel removably mounted to said housing adjacent one of the said rails.

3. The improved rumble strip cutting machine of claim 2, further including a wheel assembly adjacent the other of said rails whereby said piston wheel can be removed from the position adjacent said one of said rails and attached to said wheel assembly adjacent said other of said rails.

4. The improved rumble strip cutting machine of claim 1, further including a lifting structure positioned between one of said connectors and said rumble strip cutting drum enabling said housing to be lifted so that said rumble strip cutting drum can be spaced from the road surface when the improved rumble strip cutting machine is being moved from one job site to another.

5. An improved rumble strip cutter including a frame having opposing rails spaced from each other and in substantially parallel relationship, said rails having opposing ends, a rumble strip cutter drum rotatably mounted on said frame at one end of said rails and adjacent one of said rails; including a. a pivotal connector adjacent the other end of said rails for pivotally connecting said frame to a tractor;

b. a power input pulley rotatably mounted on said frame for supplying power to said rumble strip cutter drum;

c. a belt for transmitting power from a power output source on a tractor to said power input pulley; and d. a rail length adjustment device on at least of one said rails to enable the tension on said belt to be adjusted.

6. The improved rumble strip cutting machine of claim 5, wherein the rail length adjustment device includes a rod operatively engaging the rails and the tractor to vary the position of the rails with respect to the tractor.

7. The improved rumble strip cutting machine of claim 6, wherein the rail length adjustment device includes a mount plate engaging the rails proximate the pivotal connector and positioned to engage the tractor.

* * * * *